US012392133B2

(12) United States Patent
Yokoyama et al.

(10) Patent No.: US 12,392,133 B2
(45) Date of Patent: Aug. 19, 2025

(54) INTERIOR BUILDING MATERIALS

(71) Applicant: YOSHINO GYPSUM CO., LTD., Tokyo (JP)

(72) Inventors: Itaru Yokoyama, Tokyo (JP); Ken Watanabe, Tokyo (JP)

(73) Assignee: YOSHINO GYPSUM CO., LTD., Tokyo (JP)

( * ) Notice: Subject to any disclaimer, the term of this patent is extended or adjusted under 35 U.S.C. 154(b) by 214 days.

(21) Appl. No.: 18/459,980

(22) Filed: Sep. 1, 2023

(65) Prior Publication Data

US 2024/0076868 A1 Mar. 7, 2024

Related U.S. Application Data

(63) Continuation-in-part of application No. 16/468,561, filed as application No. PCT/JP2018/009504 on Mar. 12, 2018, now abandoned.

(30) Foreign Application Priority Data

Mar. 16, 2017 (JP) ..... 2017-051273

(51) Int. Cl.
*E04B 2/74* (2006.01)
*E04B 2/72* (2006.01)

(52) U.S. Cl.
CPC ..... *E04B 2/74* (2013.01); *E04B 2/723* (2013.01); *E04B 2002/7468* (2013.01)

(58) Field of Classification Search
CPC .... E04B 2/723; E04B 2/74; E04B 2002/7468; E04C 2/043; E04C 2/28; E04C 2/46;
(Continued)

(56) References Cited

U.S. PATENT DOCUMENTS 1,871,843 A 8/1932 Ericson
1,943,663 A 1/1934 Ericson
(Continued)

FOREIGN PATENT DOCUMENTS

CN 1368910 9/2002
JP 56-003941 1/1981
(Continued)

OTHER PUBLICATIONS

International Search Report, issued in the corresponding PCT application No. PCT/JP2018/009504, dated May 1, 2018, 5 pages.
(Continued)

*Primary Examiner* — James M Ference
(74) *Attorney, Agent, or Firm* — HSML P.C.

(57) ABSTRACT

The present invention intends to provide a technique by which, in an interior building material which is represented by a gypsum board and to which a magnet does not attach, the surface of such an interior building material can be modified so that a magnet can attach to the surface by simple means that can be put into practical use, a wall face and the like for which a stopper with a magnet, which is a substitute for a thumbtack, and a magnet sheet are usable can thereby be formed, and an interior building material which has realized favorable construction efficiency such that the interior building material can be easily cut with a cutter knife or the like can be made, and this object is realized by providing an interior building material having a plurality of sheet-like magnetic materials fixed to at least a portion of a surface or back surface of a plate-like base material to which a magnet does not attach, wherein adjacent magnetic materials are disposed in such a way as to have a portion where the adjacent magnetic materials are in contact with each other, or adjacent magnetic materials are disposed through a gap having a narrow portion.

15 Claims, 13 Drawing Sheets

(58) Field of Classification Search
CPC ... E04F 13/08; E04F 13/0662; E04F 13/0883; E04F 13/12; E04F 13/14; E04F 2201/06
USPC ..... 52/506.01
See application file for complete search history.

(56) References Cited

U.S. PATENT DOCUMENTS

| | | | | |
|---|---|---|---|---|
| 3,341,996 | A * | 9/1967 | Jones | E04F 15/02144 427/127 |
| 3,527,004 | A | 9/1970 | Sorensen | |
| 3,609,934 | A * | 10/1971 | O'Carroll | E04F 13/0883 52/461 |
| 3,629,756 | A * | 12/1971 | Holtz | H01F 7/0215 52/DIG. 4 |
| 3,899,762 | A | 8/1975 | Studders | |
| 4,042,897 | A | 8/1977 | Seidel | |
| 4,298,647 | A | 11/1981 | Cancio et al. | |
| 4,380,564 | A | 4/1983 | Cancio et al. | |
| 4,744,186 | A * | 5/1988 | Smith | E04B 1/942 52/404.3 |
| 4,870,788 | A | 10/1989 | Hassan | |
| 4,927,696 | A | 5/1990 | Berg | |
| 4,937,992 | A | 7/1990 | Dawson et al. | |
| 5,030,045 | A | 7/1991 | Dawson et al. | |
| 6,367,218 | B2 | 4/2002 | Lombardo | |
| 6,539,643 | B1 | 4/2003 | Gleeson | |
| 6,562,444 | B1 | 5/2003 | Gleeson et al. | |
| 7,992,265 | B2 | 8/2011 | Suenaga | |
| 8,999,478 | B1 | 4/2015 | Medlen | |
| 9,849,649 | B2 | 12/2017 | Immordino et al. | |
| 10,189,236 | B2 * | 1/2019 | Lautzenhiser | E04F 13/0883 |
| 11,285,699 | B2 * | 3/2022 | Bassi | B32B 21/08 |
| 2003/0150190 | A1 | 8/2003 | Schroth | |
| 2004/0231212 | A1 | 11/2004 | Roche | |
| 2005/0262787 | A1 | 12/2005 | Goss | |
| 2006/0240737 | A1 | 10/2006 | Yoon | |
| 2008/0202053 | A1 * | 8/2008 | Guy | E04F 15/02144 52/391 |
| 2009/0110948 | A1 | 4/2009 | Buckel | |
| 2009/0193629 | A1 | 8/2009 | Suenaga | |
| 2009/0206592 | A1 | 8/2009 | Summerhayes | |
| 2009/0263634 | A1 | 10/2009 | Hyer et al. | |
| 2009/0320407 | A1 | 12/2009 | Johansson | |
| 2010/0236159 | A1 | 9/2010 | Hyer et al. | |
| 2011/0052866 | A1 | 3/2011 | Roche | |
| 2012/0256717 | A1 | 10/2012 | Roche | |
| 2012/0260467 | A1 | 10/2012 | Roche | |
| 2013/0161481 | A1 | 6/2013 | Kegeris | |
| 2014/0220271 | A1 | 8/2014 | Meyer | |
| 2015/0258845 | A1 | 9/2015 | Hannig | |
| 2015/0348705 | A1 | 12/2015 | Takagi | |
| 2016/0047117 | A1 * | 2/2016 | DeRita | E04B 2/7457 52/745.1 |
| 2016/0236444 | A1 | 8/2016 | Immordino et al. | |
| 2016/0319553 | A1 | 11/2016 | Lautzenhiser et al. | |
| 2017/0037629 | A1 | 2/2017 | Srivastava et al. | |
| 2017/0114547 | A1 * | 4/2017 | Boyd | E04F 13/0883 |
| 2018/0056627 | A1 * | 3/2018 | Immordino, Jr. | B32B 13/08 |
| 2020/0080320 | A1 | 3/2020 | Yokoyama et al. | |
| 2022/0112716 | A1 * | 4/2022 | Yokoyama | E04F 13/072 |
| 2023/0235569 | A1 * | 7/2023 | Kandrashou | E04F 13/0866 52/481.2 |
| 2024/0076868 | A1 * | 3/2024 | Yokoyama | E04B 2/74 |

FOREIGN PATENT DOCUMENTS

| | | |
|---|---|---|
| JP | 2003-501705 | 1/2003 |
| JP | 2006-097356 | 4/2006 |
| JP | 2008-087404 | 4/2008 |
| JP | 2014-152596 | 8/2014 |
| JP | 2017-036650 | 2/2017 |
| KR | 10- 2009-0128658 | 12/2009 |
| RU | 56260 | 9/2006 |
| WO | 2000/076700 | 12/2000 |

OTHER PUBLICATIONS

Australian Examination Report No. 1, issued in the corresponding Australian patent application No. 2018235525, dated Apr. 6, 2020, 3 pages.

Russian Office Action, issued in corresponding Russian patent application No. 2019130571/03(060056), dated Apr. 14, 2020,11 pages.

First Indian Examination report, issued in the corresponding Indian patent application No. 201917026191, dated Jun. 19, 2020, 5 pages.

Russian Office Action, issued in corresponding Russian Patent Application No. 2019130571/03(060056), dated Aug. 10, 2020, 9 pages including English translation.

Chinese Office Action, issued in corresponding Chinese Patent Application No. 201880018520.1 dated Aug. 11, 2020, 16 pages including English translation.

Australian Examination report, issued in the corresponding Australian patent application No. 2018235525, dated Sep. 15, 2020, 4 pages.

Korean Office Action, issued in corresponding Korean Patent Application No. 10-2019-7021773, dated Feb. 18, 2021, 17 pages (including English translation).

Diamond Life MaxTile F1; accessed using Internet Archive; Feb. 22, 2016; accessed Sep. 20, 2022 https ://web.archive .org/web/20160222192826/https://diamondl ifegear.com/metal-wainscoting-tiles .html (Year: 2016).

* cited by examiner

[Figure 1]
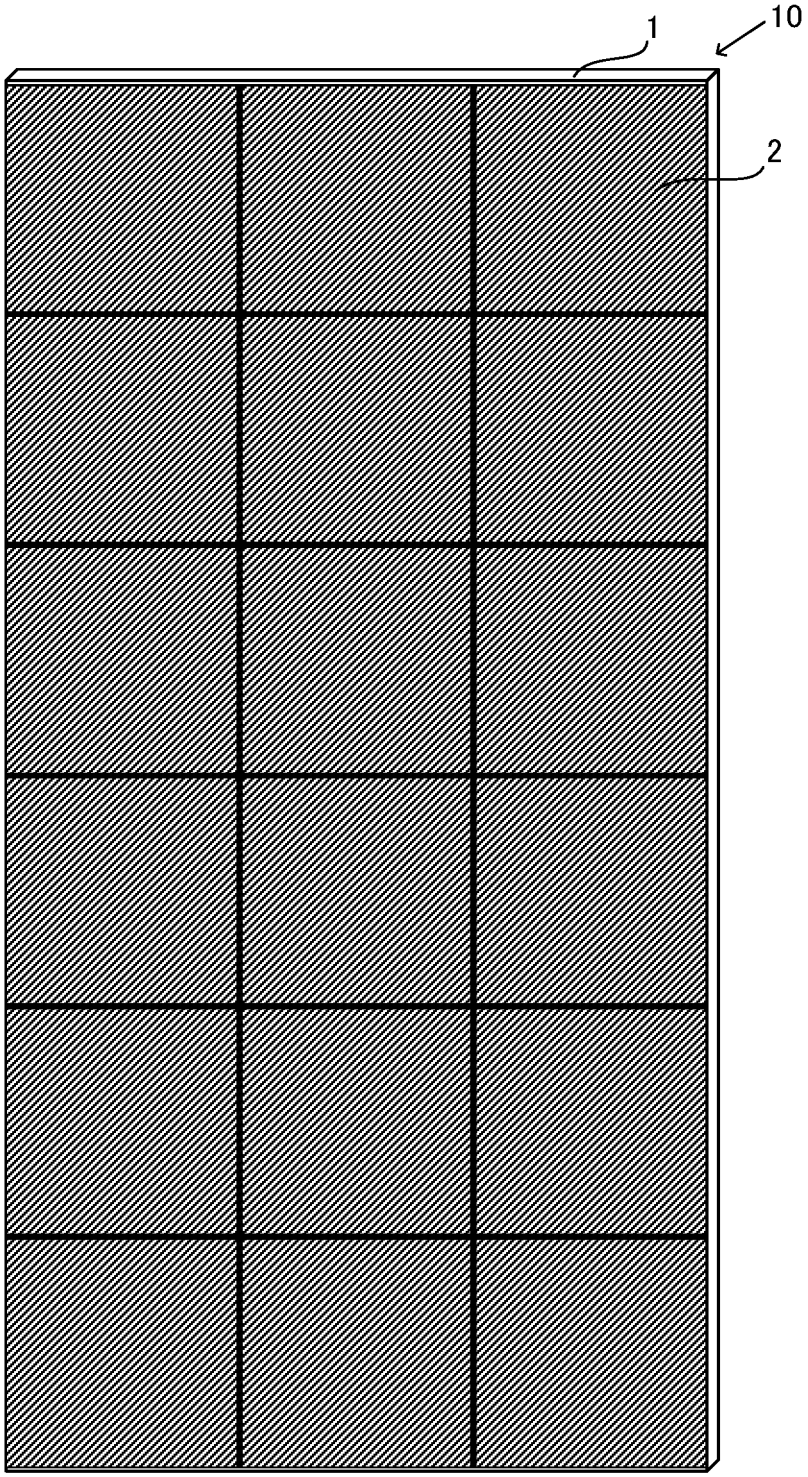

[Figure 2]
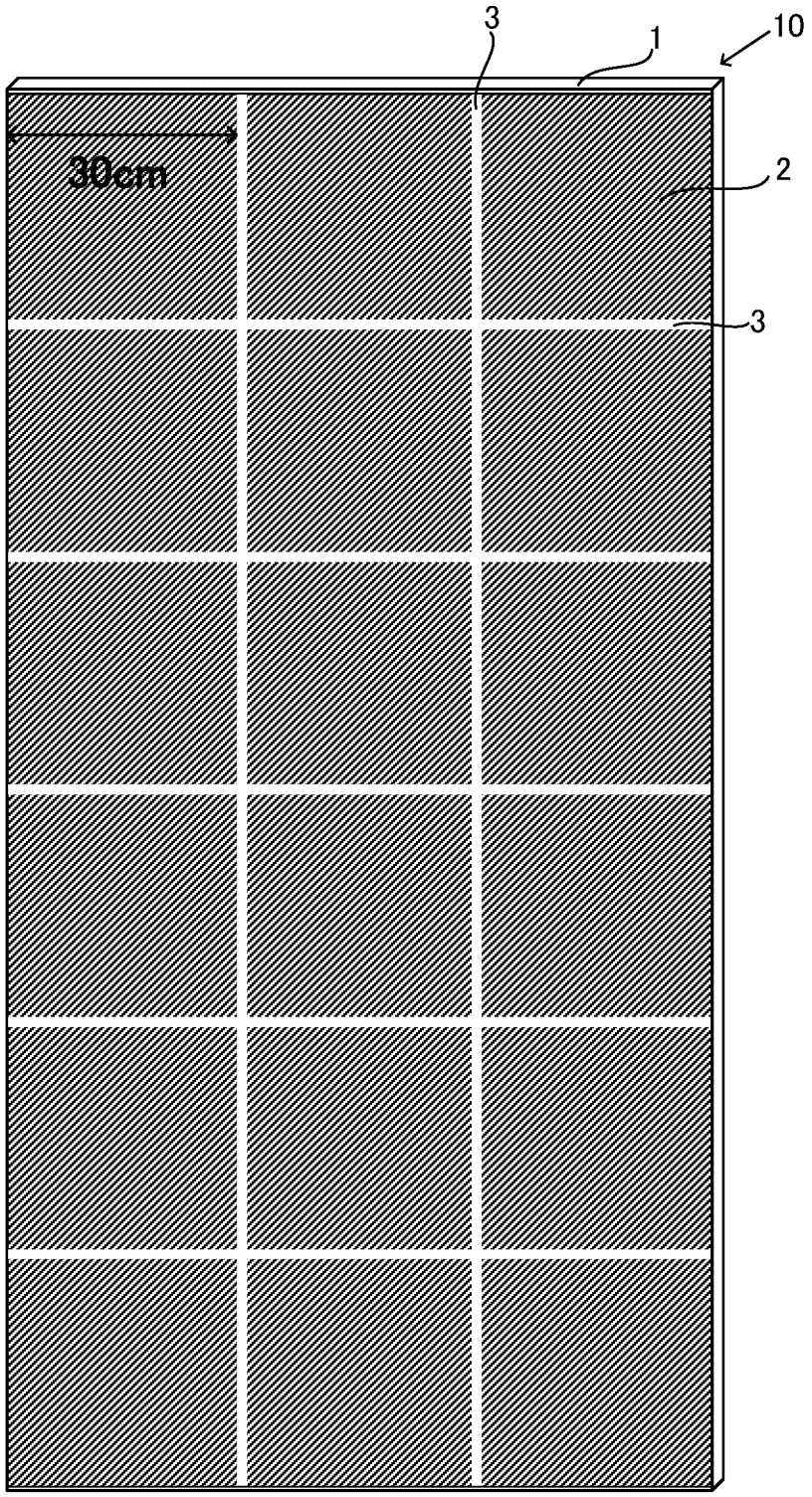

[Figure 3]
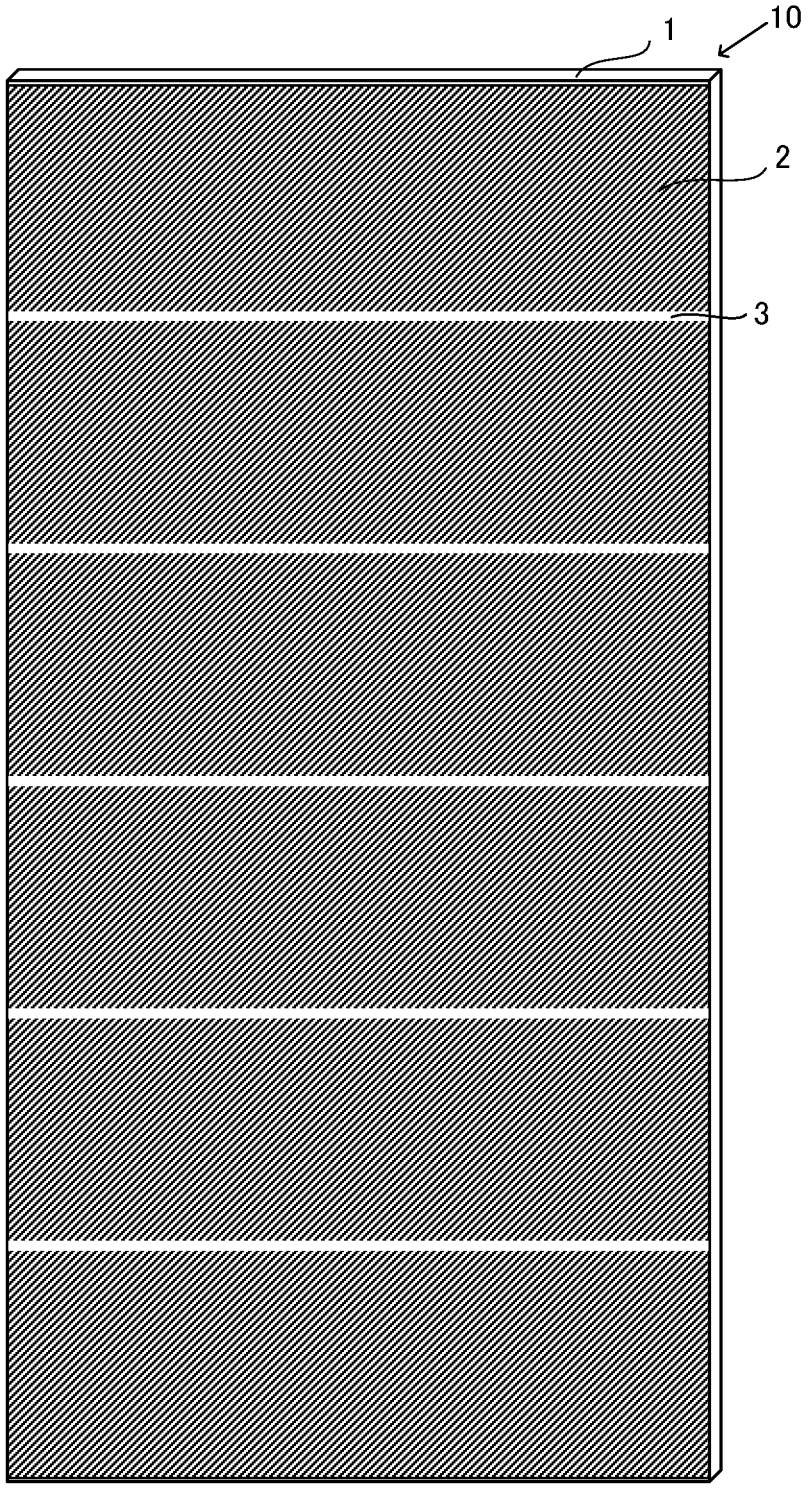

[Figure 4]
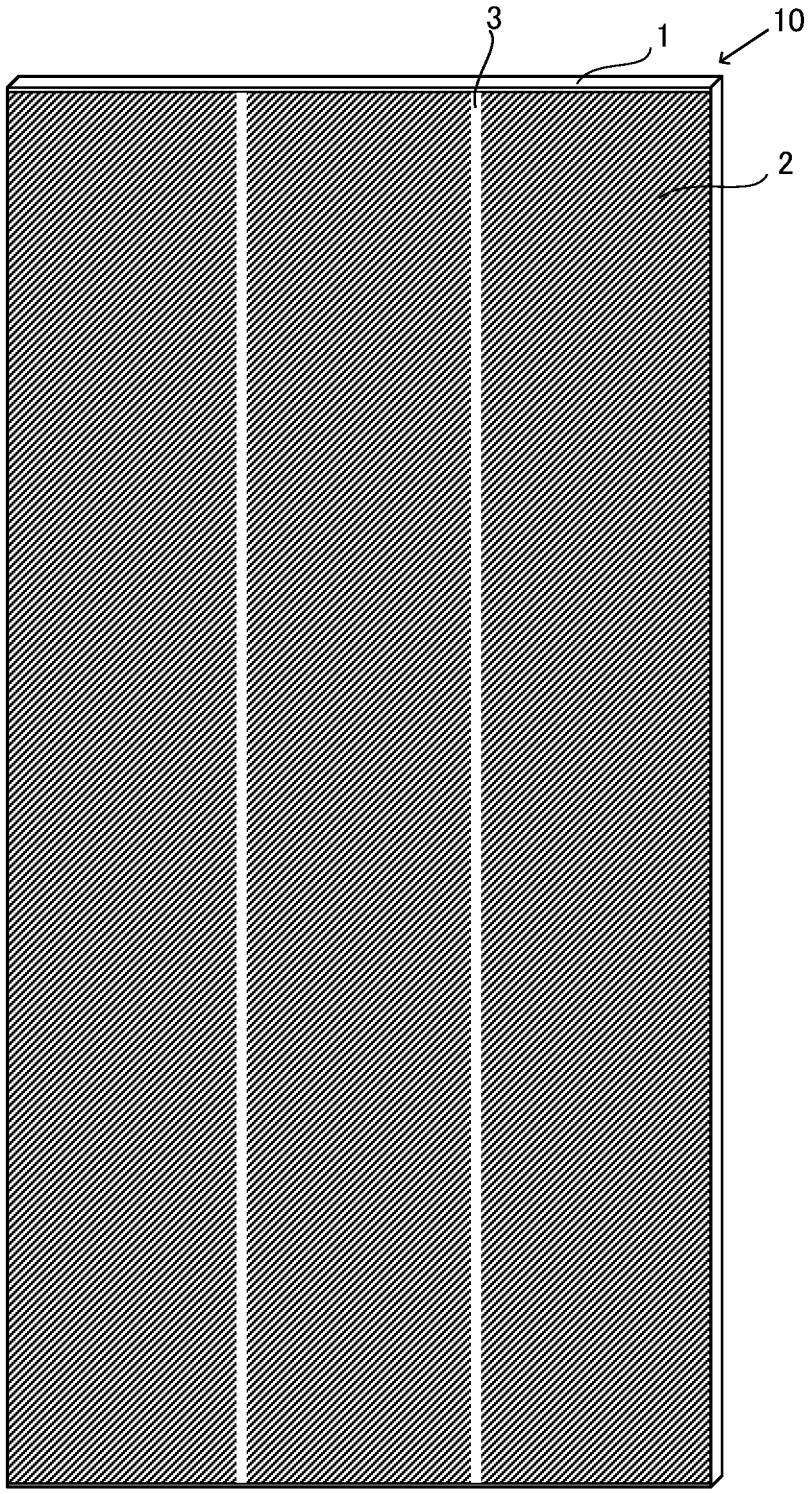

[Figure 5]
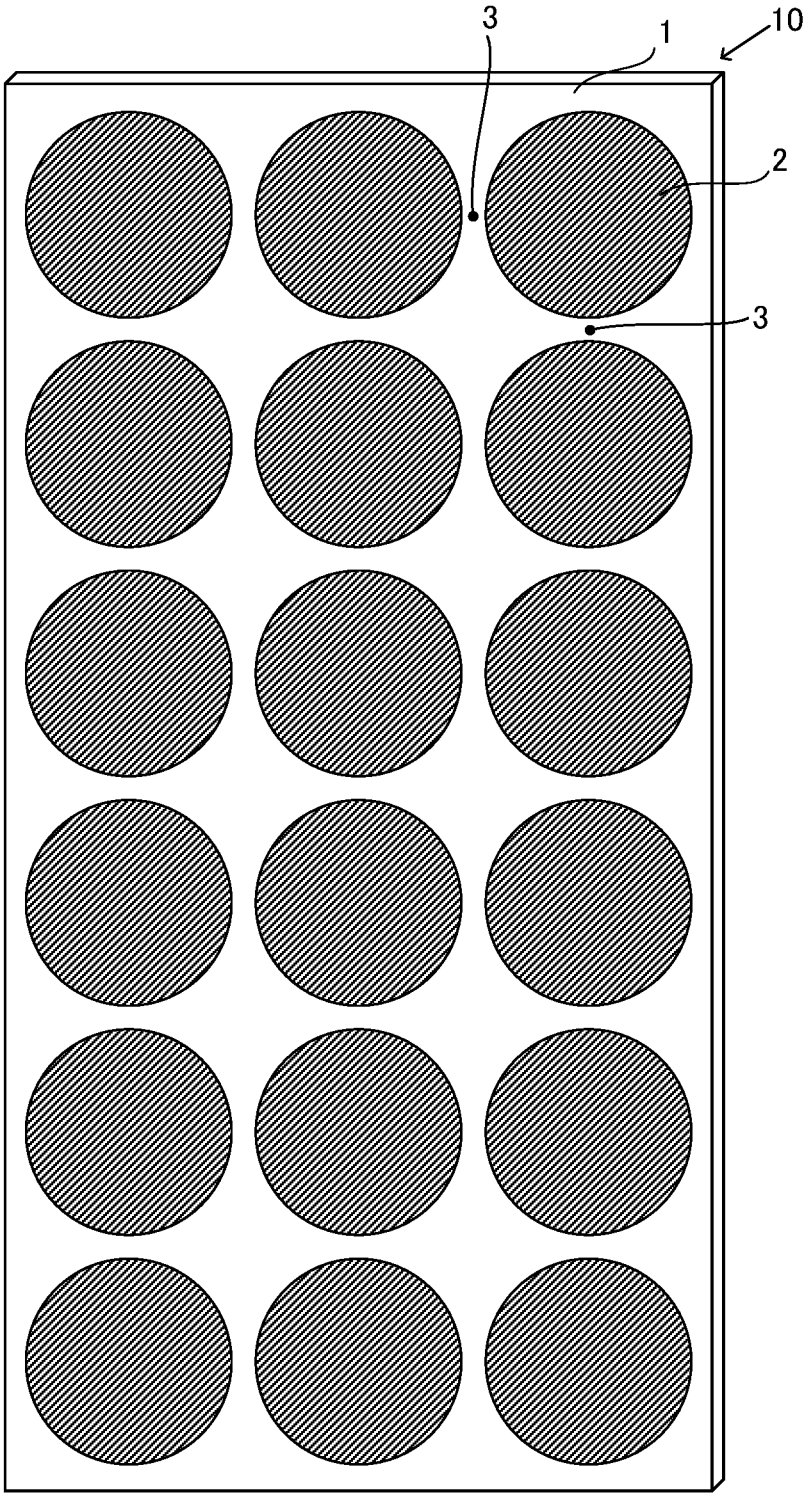

[Figure 6]
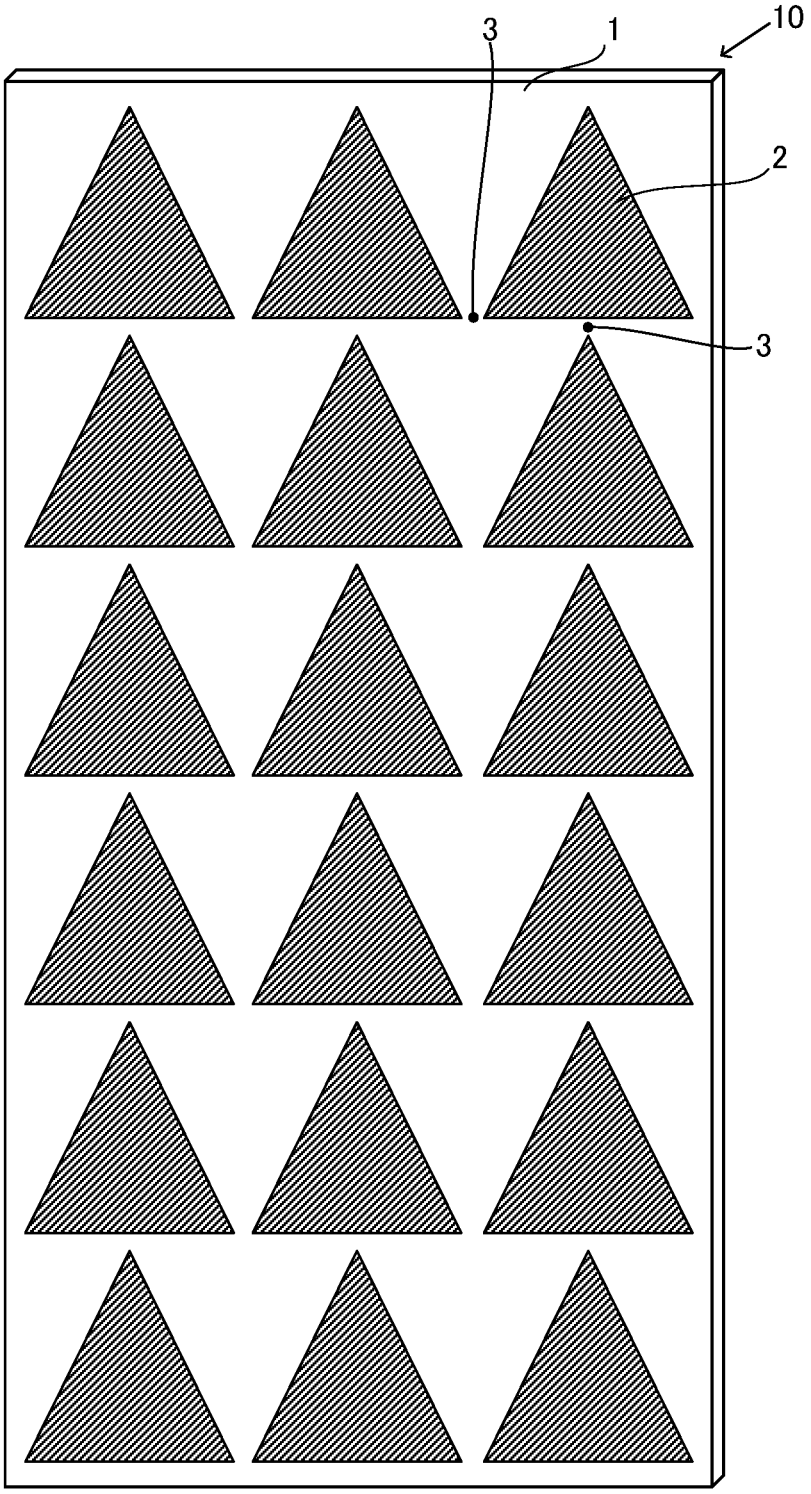

[Figure 7]
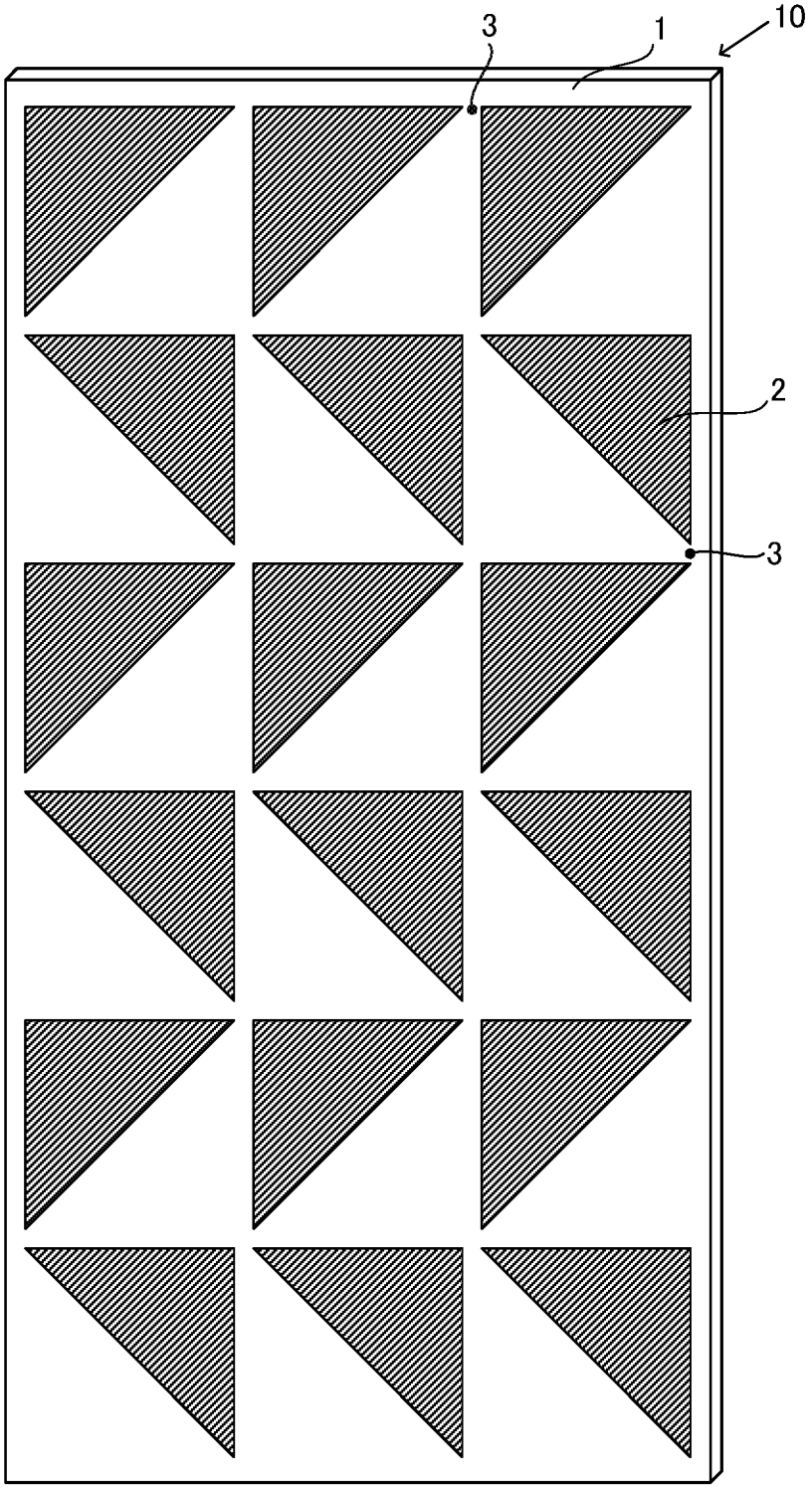

[Figure 8]
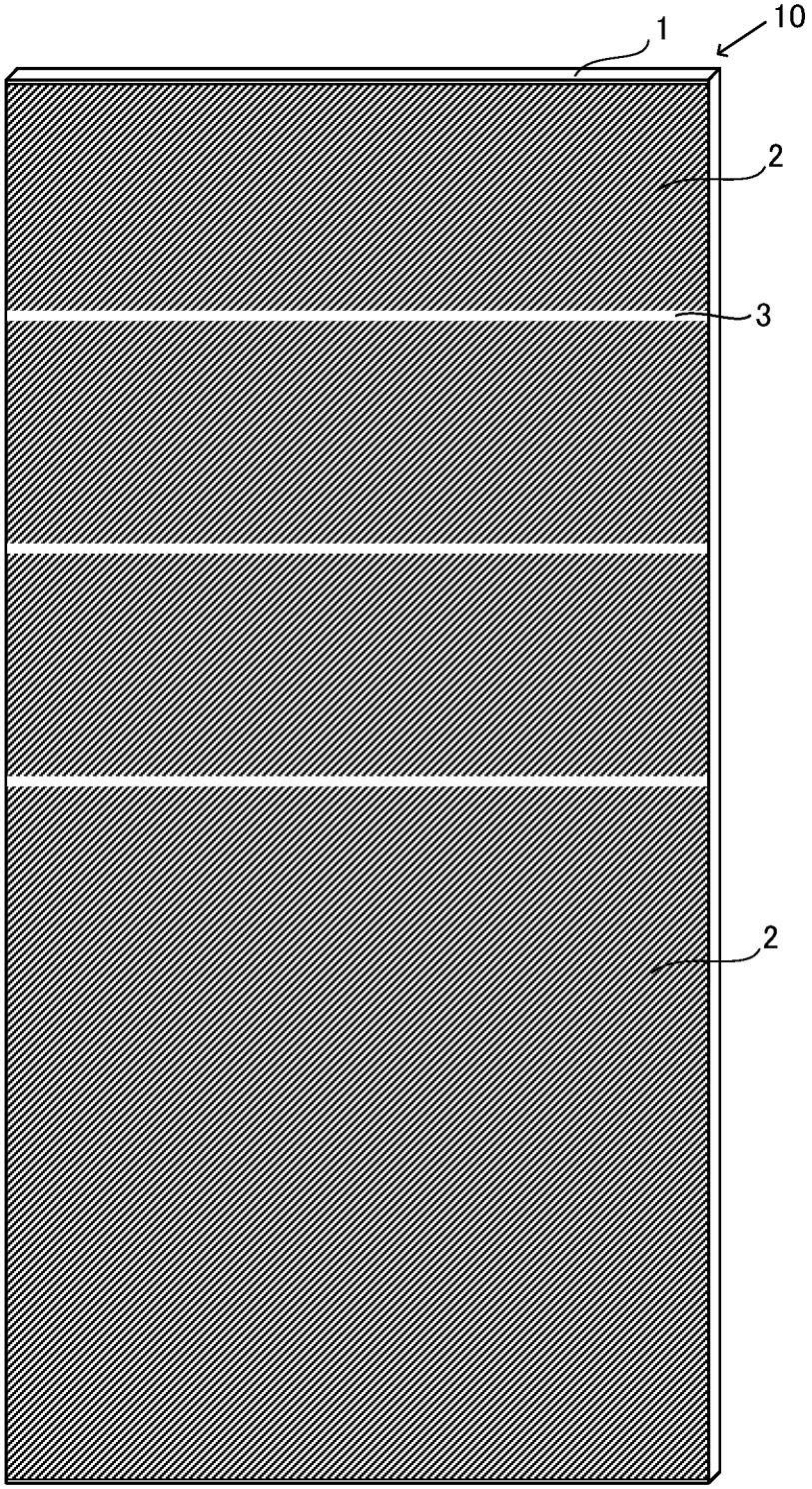

[Figure 9]
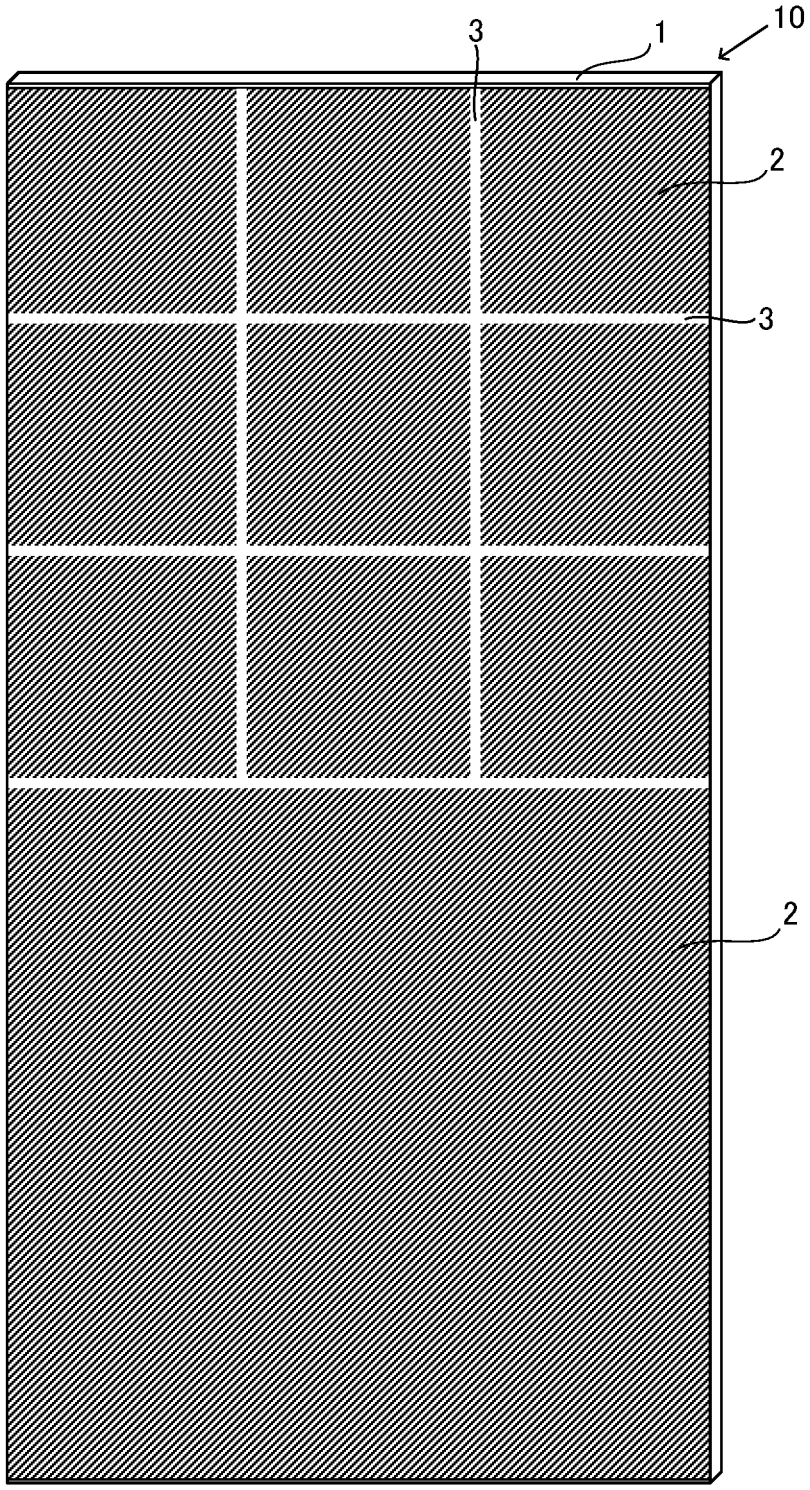

[Figure 10]
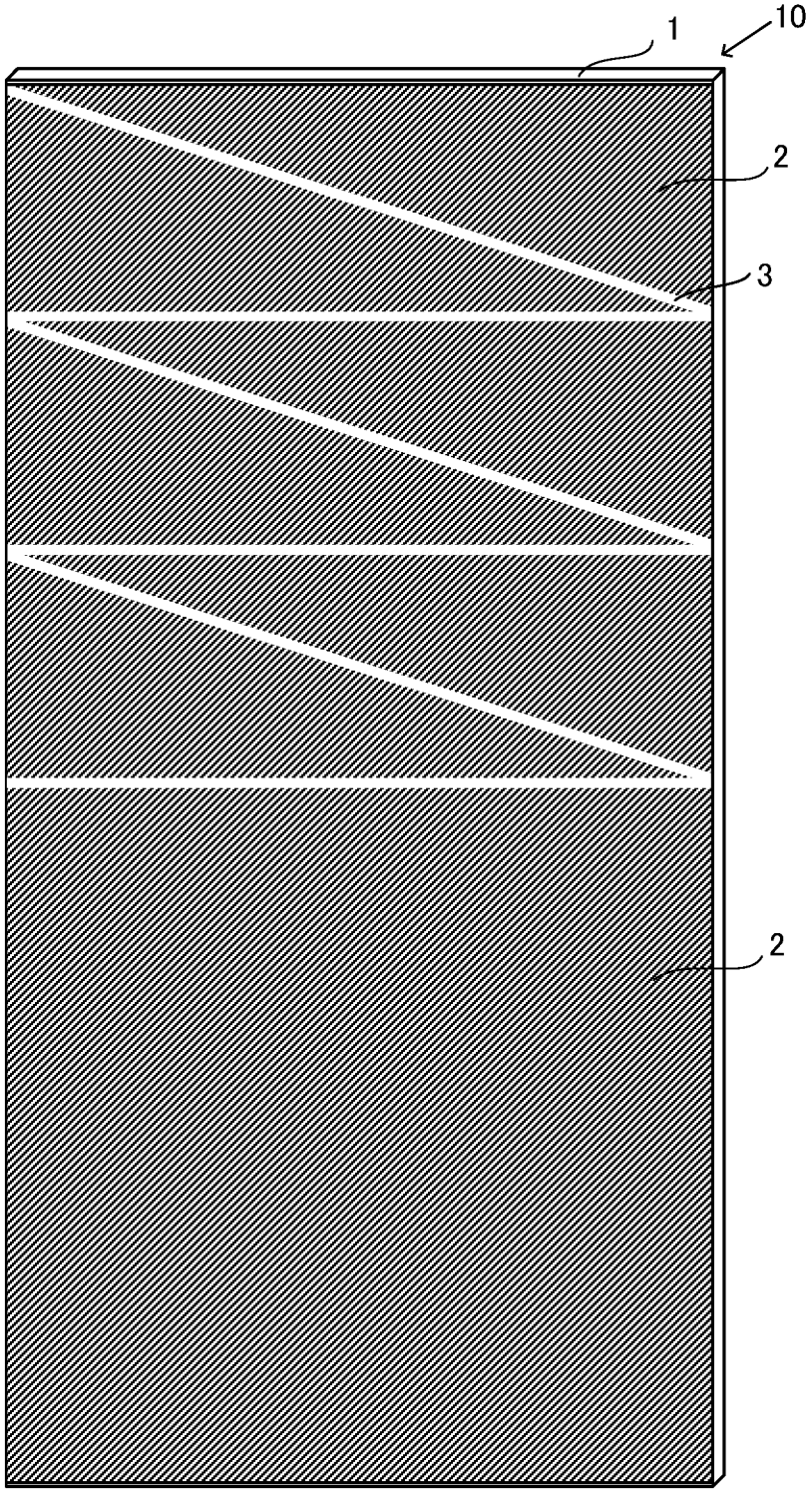

[Figure 11]
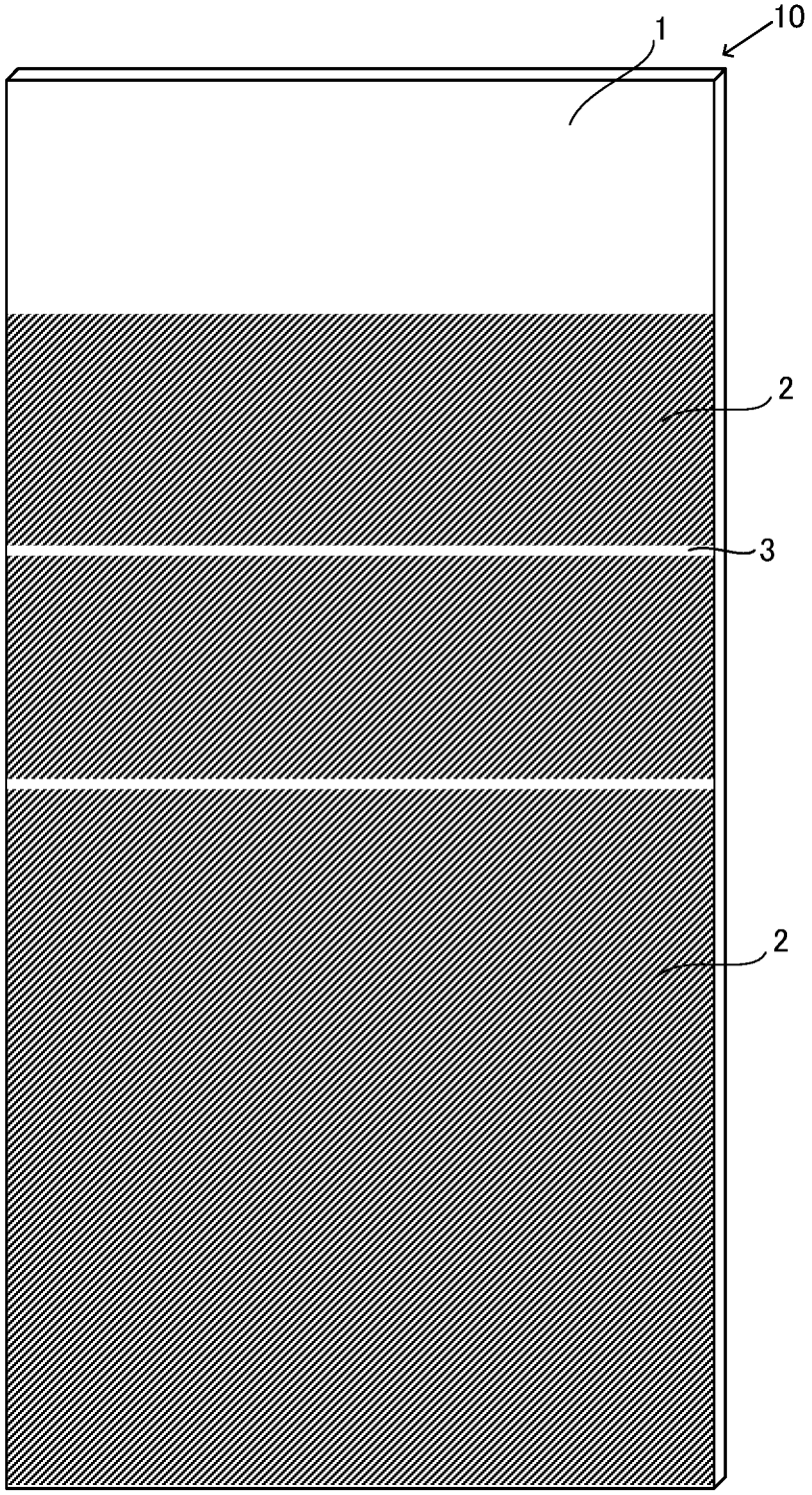

[Figure 12]
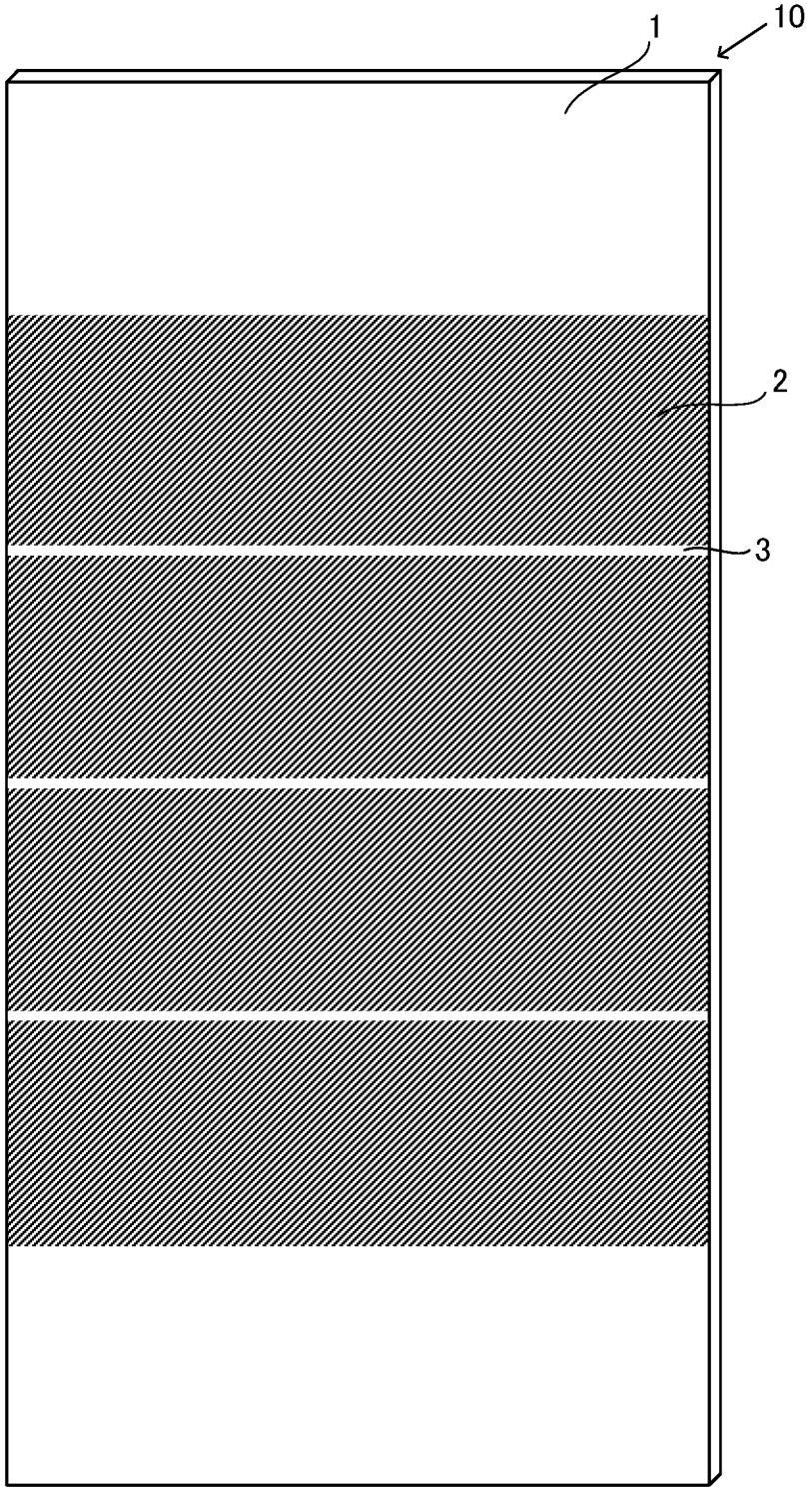

[Figure 13]
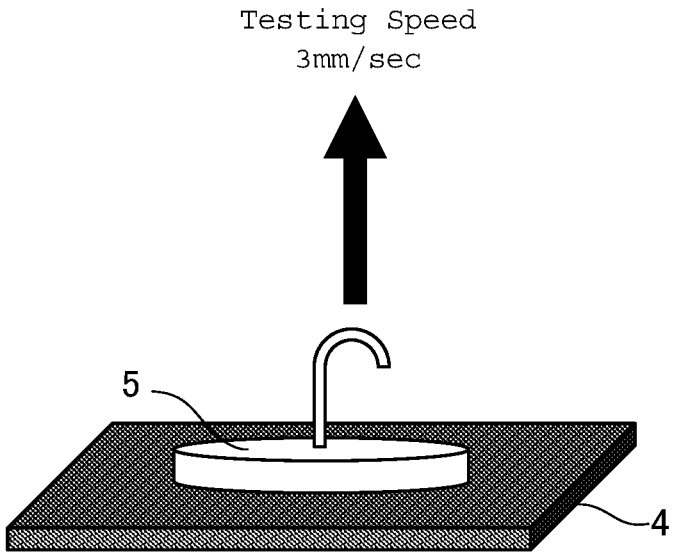

INTERIOR BUILDING MATERIALS

TECHNICAL FIELD

The present invention relates to an improvement in an interior building material including a plate-like base material, such as a gypsum board, to which a magnet does not attach inherently and specifically relates, to an interior building material to be used for forming an interior wall and the like, wherein: a functionality that a magnet, which is a magnetic material, can be attached to a surface of the interior building material has been imparted; and, in addition to this functionality, favorable construction efficiency such that the interior building material can be easily cut with a cutter knife or the like has been achieved.

BACKGROUND ART

A gypsum board (also called a plaster board) is a building material obtained by shaping a material which uses gypsum as a main component into a plate and wrapping the plate with a special paperboard, and is very strong, has excellent fire resistance, and has high levels of heat insulating properties and sound insulating properties, so that gypsum boards are widely used as interior building materials in making walls and ceilings. The reason that the gypsum boards have been widely used as interior building materials is also due to the fact that, in addition to the above-described excellent functionalities, the gypsum boards are excellent in construction efficiency by which the gypsum boards can be easily cut with a simple sharp cutting tool such as a cutter knife even though the gypsum boards are building materials made of an inorganic material.

However, to favorably display, for example, a picture, a photograph, or the like on a wall face made of a gypsum board, a special anchor developed for gypsum boards needs to be used. In addition, there is a problem that in the case where a usual screw, nail, or thumbtack, or a special anchor for gypsum boards, which has been forcibly used for a wall face made of a gypsum board, is pulled out when it becomes unnecessary to use them, a hole is left on a wall. The problem that a hole is left on a wall after a screw, a nail, a thumbtack, or the like is pulled out occurs similarly to other interior building materials, not limited to the gypsum boards.

To solve this problem, a stopper with a magnet, which makes it unnecessary to make a hole in a wall and is a substitute for a thumbtack is developed, and such stoppers with a magnet are widely used for walls made of steel or the like. In addition, a magnet sheet which can be easily attached to walls made of steel or the like and has an image, characters, or the like thereon, a magnet sheet which can also be utilized as a white board, and the like are known, and such magnet sheets are widely used because they are freely attachable and detachable, and a trace of detachment is not left on a wall.

However, these products which employ a system of attaching them to a wall with a magnet restrict wall materials and cannot be used, for example, for generally used wall faces made of a gypsum board. To use such products, a sheet dedicated for attaching a magnet sheet needs to be installed on a wall face, and therefore another problem that the design property of a wall face is impaired arises in addition to complication.

To solve the above-described problems, there is a proposal on a wall member in which a magnetic sheet such as a steel sheet is pasted to a surface of a support member such as a gypsum board, and wallpaper is superimposed on the surface of the magnetic sheet (see Patent Literature 1). In addition, a building material in which a material such as a gypsum board and a metal sheet are laminated and made into a composite, the building material being developed in order to prevent malfunction of electronic devices, has been known in recent years, and there is a possibility that a magnet can be attached to the surface of the b building material in some cases (see Patent Literature 2).

CITATION LIST

Patent Literature

Patent Literature 1: Japanese Patent Laid-Open No. 2014-152596

Patent Literature 2: Japanese Patent Laid Open No. 2008-87404

SUMMARY OF INVENTION

Technical Problem

However, according to studies conducted by the present inventors, in the wall member described in Patent Literature 1, the magnetic sheet such as a steel sheet is pasted to almost the whole face of the support member such as a gypsum board or pasted to the support member over a large area even if the magnetic sheet is pasted to only a portion of the support member, and therefore the construction efficiency of the support member is remarkably inferior. In addition, the specific wall member described in Patent Literature 1 has constitution in which: a magnetic sheet such as a steel sheet is pasted, with a double sided tape or an adhesive, to the surface of a commercially available gypsum board both surfaces of which are covered with paper; and a paperboard is superposed on the magnetic sheet, so that a part where a magnet can be attached to a wall face is formed by construction work, and therefore, the construction work is extremely complicated and the constitution is such that the wall member cannot be used for general purposes.

In addition, the previously described building material developed in order to prevent malfunction of electronic devices intends to impart electromagnetic wave shielding properties, and therefore most of the metal sheets that are described to be usable are those of types to which a magnet does not attach. Further, with respect to the structure of the building material, many materials are laminated on the metal sheet, and therefore the building material is not constituted so that a magnet can attach to the surface thereof.

On the other hand, paints each obtained by blending a magnetic substance such as an iron powder are commercialized, and an interior building material such as a gypsum board can be constructed so that a magnet can attach thereto by providing a coating film on the surface thereof. However, in this case, construction of thick coating on the construction site needs to be carried out, and therefore it is difficult to apply a paint uniformly and there are various problems that the construction requires a great deal of skill, the construction site gets dirty, high incombustibility of a gypsum board cannot be secured, etc. so that such paints cannot be used for general purposes, which is similar to the technique described in Patent Literature 1.

To solve these problems, it is also considered that a coating film layer containing a magnetic substance is formed in advance by applying a paint containing a magnetic substance blended therein on an interior building material such as a gypsum board. However, in this case, there is a practical problem that facilities and a technique for coating the surface of the interior building material uniformly with a paint, and facilities and a technique for drying are required, making the scale of the facilities large.

Accordingly, an object of the present invention is to provide an interior building material by which: in an interior building material which is represented by a gypsum board and to which a magnet does not attach, the surface of such an interior building material can be modified so that a magnet can attach to the surface by simple means that can be put into practical use; a wall face and the like for which a stopper with a magnet, which is a substitute for a thumbtack, and a magnet sheet are usable can thereby be formed; and favorable construction efficiency such that the interior building material can be easily cut with a cutter knife or the like has been achieved.

Solution to Problem

The above-described object is achieved by the present invention described below. That is, the present invention provides an interior building material comprising a plurality of sheet-like magnetic materials fixed to at least a portion of a surface or back surface of a plate-like base material to which a magnet does not attach, wherein adjacent magnetic materials are disposed in such a way as to have a portion where the adjacent magnetic materials are in contact with each other, or adjacent magnetic materials are disposed through a gap having a narrow portion.

Preferred embodiments of the interior building material according to the present invention include the followings.

The adjacent magnetic materials are disposed in such a way as to be in contact with each other and the plurality of sheet-like magnetic materials are fixed in a state of being arranged without a gap; the narrow portion of the gap is within a range of 0.05 to 5.0 mm; the narrow portion of the gap is within a range of 0.10 to 1.0 mm; the plurality of sheet-like magnetic materials have the same shape, and the shape is any one of shapes selected from the group consisting of a square, a rectangle, a trapezoid, a triangle, a circle, and an ellipse; four sides of the square, two sides of the rectangle, at least one side of the trapezoid or the triangle, a diameter of the circle, or at least one of a major axis and a minor axis of the ellipse is 10 cm to 35 cm; the gap is formed by only the narrow portion, and the narrow portion is linear; at least one of the plurality of sheet-like magnetic materials is a sheet-like magnetic material having a through hole; at least one of the plurality of sheet-like magnetic materials has a chamfered portion at an outer circumference thereof; when the interior building material is stood in such a way as to be vertical, and one sheet of A4 plain paper is held at a portion where the sheet-like magnetic materials are disposed with one disk-like magnet having a diameter of a magnet portion of 17 mm $\phi$ and having a force of attraction of 3.5 N to an iron sheet having a thickness of 1 mm, the portion where the sheet-like magnetic materials are disposed has force of attraction by which the plain paper does not fall; having a structure in which the base material is a plate-like member made of gypsum, and, further, a paper sheet is pasted on the plurality of disposed sheet like magnetic materials; the sheet-like magnetic materials have a thickness of 0.1 to 1.0 mm; the sheet-like magnetic materials have a thickness of 0.2 to 0.8 mm; any one of the plurality of sheet-like magnetic materials is an iron sheet or a steel sheet having rust-proofing performed on both faces or one face thereof; having a thickness of 9.5 to 10.0 ram; and having a thickness of 12.5 to 13.0 mm.

Advantageous Effects of Invention

According to the present invention, a highly convenient interior building material in which an interior building material the surface of which cannot be attached to a magnet, the interior building material represented by a gypsum board, has been modified so that the surface thereof can be attached to a magnet by simple means that can be put into practical use is provided although the highly convenient interior building material has simple constitution. According to the present invention, a highly convenient interior building material wherein when plain paper or the like is held on the surface of the interior building material with a stopper with a magnet which is a substitute for a thumbtack, a magnet sheet, or the like, which has been used in various types and forms in a wide range of fields, the interior building material exhibiting force of attraction of the magnet which is sufficient for the interior building material to be able to hold the plain paper, and, further, a highly convenient wall face using the highly convenient interior building material are provided by adopting the above-described constitution. The most advantageous point of the present invention is in that according to the present invention, there is provided an interior building material which is a highly convenient interior building material as described above, and by which favorable construction efficiency such that a cutter knife can be inserted between adjacent sheet-like magnetic materials, and thereby the interior building material can be easily cut into an appropriate size has been achieved.

BRIEF DESCRIPTION OF DRAWINGS

FIG. 1 is a schematic diagram illustrating an interior building material of Example 2 according to the present invention.

FIG. 2 is a schematic diagram illustrating an interior building material of Example 1 according to the present invention.

FIG. 3 is a schematic diagram illustrating another example of the interior building material according to the present invention.

FIG. 4 is a schematic diagram illustrating another example of the interior building material according to the present invention.

FIG. 5 is a schematic diagram illustrating another example of the interior building material according to the present invention.

FIG. 6 is a schematic diagram illustrating another example of the interior building material according to the present invention.

FIG. 7 is a schematic diagram illustrating another example of the interior building material according to the present invention.

FIG. 8 is a schematic diagram illustrating another example of the interior building material according to the present invention.

FIG. 9 is a schematic diagram illustrating another example of the interior building material according to the present invention.

FIG. 10 is a schematic diagram illustrating another example of the interior building material according to the present invention.

FIG. 11 is a schematic diagram illustrating another example of the interior building material according to the present invention.

FIG. 12 is a schematic diagram illustrating another example of the interior building material according to the present invention.

FIG. 13 is a schematic diagram describing a method for measuring force of attraction of a magnet to a 1-mm iron sheet, the magnet used in evaluating the force of attraction of the interior building material according to the present invention to the magnet.

DESCRIPTION OF EMBODIMENTS

Hereinafter, the present invention will be described in detail giving preferred embodiments. The present invention is not restricted by the following embodiments, and various modifications and replacements of the following embodiments can be added without deviation from the scope of the present invention.

The present inventors have conducted diligent studies in order to solve the previously described problems of the conventional techniques to recognize that any of the conventional techniques in which a plate-like base material, such as a gypsum board, to which a magnet does not attach is modified so that the surface thereof can be attached to a magnet deteriorates the construction efficiency and design property of the base material and lacks the industrial applicability, and this point is the biggest technical problem in the conventional techniques. Studies have been conducted based on such recognition to find that in the case where constitution is made in such a way that a plurality of sheet-like magnetic materials are disposed and fixed to at least a portion of the surface or the back surface of the base material so that the surface can be attached to a magnet, an embodiment is made in such a way that adjacent magnetic materials are made to be in contact with each other and the plurality of sheet-like magnetic materials are fixed in a state of being arranged without a gap, or an embodiment is made in such a way that a plurality of adjacent sheet-like magnetic materials are disposed and fixed through a gap having at least a narrow portion, and thereby an interior building material in which the problems of the conventional techniques are solved, which is highly convenient, and which is excellent in construction efficiency can be made, and thus the present inventors have reached the present invention.

That is, the present inventors have found that by fixing a plurality of sheet-like magnetic materials in a state of being arranged without a gap, or by arranging and fixing a plurality of sheet-like magnetic materials through a gap having a narrow portion, the interior building material according to the present invention is in a state where the adjacent sheet-like magnetic materials are cut and separated even in the state where the sheet-like magnetic materials are arranged without a gap, not to mention the case where the gap is provided, so that a blade of a cutter knife can be easily inserted between the sheet-like magnetic materials, and the construction efficiency which is similar to that before the modification can thereby be secured.

According to studies conducted by the present inventors, for example, even in the case where an interior building material 10 is made by fixing on a gypsum board, which is a plate-like base material shown by reference sign 1 in FIG. 1, a plurality of galvanized steel sheets, which are sheet-like magnetic materials shown by reference sign 2, in a state of being arranged without a gap, surprisingly, a blade of a cutter knife can be easily inserted between the adjacent magnetic materials by bending the above-described interior building material 10 a little so that the side on which the plurality of galvanized steel sheets are fixed is made convex, and as a result, the present inventors have found that the interior building material having the above-described constitution can be easily cut by a cutter knife. In addition, in the case where an interior building material 10 the constitution of which is such that, as illustrated in FIG. 2, adjacent sheet-like magnetic materials 2 are arranged and fixed through a gap having a narrow part shown by reference sign 3 is made, a blade of a cutter knife or even a blade of a sharp cutting tool the thickness of which is thicker than a blade of a cutter knife can be easily inserted into this cap, and the base material can be easily cut by this blade. In this embodiment for carrying out the present invention, which is illustrated in FIG. 2, it is preferable to design the shape and disposition of the plurality of sheet-like magnetic materials 2 based on the recognition that the gap having a narrow portion 3 and being formed by disposing the plurality of sheet-like magnetic materials 2 on the base material 1 is a portion to be a position that is freely cut in the interior building material according to the present invention. By designing the shape and disposition of the plurality of sheet-like magnetic materials 2 in this way, an interior building material that is more excellent in construction efficiency can be provided.

The gap having a narrow portion 3 in the interior building material according to the present invention may be appropriately designed as necessary considering the above-described construction efficiency of the interior building material. That is, the size of the gap may have a width such that a blade of a sharp cutting tool such as a cutter knife can be easily inserted without an operation of, for example, bending the interior building material as described above at the narrow portion 3. As the specific size of the narrow portion 3 in the case where the constitution in which the gap is provided is adopted, the shortest distance between adjacent magnetic materials (narrow portion 3) may be approximately within a range of 0.05 to 5.0 mm or may be narrower as narrow as approximately within a range of 0.10 to 1.0 mm. In addition, the position where the gap is provided may be arbitrarily determined considering the convenience in cutting and using the interior building material.

Usually, the size of an interior building material is 3 shaku×6 shaku, which is a standard shaku size of panel plywood, in many cases. Therefore, in the present invention, in the case where a plurality of sheet-like magnetic materials are arranged according to either of the above-described types of constitution, it is preferable to adopt the constitution in which magnetic materials are each disposed at a position where construction work is easily done and the magnetic materials can be cut at every desired, predetermined intervals. In the case where the interior building material is cut at a portion where adjacent magnetic materials are in contact with each other or at a gap formed by adjacent magnetic materials, it is preferable to adopt the constitution in which the gaps are disposed at every predetermined intervals in such a way that the width thereof is in a range of, for example, 10 to 35 cm, more specifically, a width of either 10 cm, 15 cm, or 30 cm.

Any of the conventional interior building materials using a metal sheet uses a metal sheet having a large area, and this has been a cause for deteriorating the construction efficiency. In contrast, in the present invention, an interior building material 10 having an embodiment in which, for example, a gypsum board which is an interior building material of 3 shaku×6 shaku is used as a base material 1, and sheet-like magnetic materials 3 of about 30-cm square are orderly arranged and fixed to the surface of the base material 1 in such a way as to be in contact with each other or through a narrow gap, as illustrated in FIG. 1 or FIG. 2, is made. By constituting the interior building material 10 in this way, the above-described deterioration of the construction efficiency, which is caused by using the above-described metal sheet having a large area, is solved, and remarkable effects of the present invention are obtained. It is to be noted that FIG. 1 and FIG. 2 are schematic diagrams and illustrates the contact portions and gaps with emphasis. The same applies to the other figures.

By constituting the interior building material 10, which is illustrated in FIG. 1 or FIG. 2, in the manner as described above, the interior building material 10 according to the present invention has the constitution in which the interior building material 10 can be cut by a cutter knife of the like at this portion where a blade of a cutter knife can be easily inserted between the adjacent sheet like magnetic materials 2 and is divided about every 30 cm. As a result, in the interior building material according to the present invention, by utilizing these divisions (contact portions and gaps) where a blade of a cutter knife can be easily inserted and cutting can be conducted, a gypsum board which is a base material 1 can be easily cut in a width (length) of, for example, 30 cm, 60 cm, 90 cm, etc. using the magnetic materials as guides without using a safety ruler or the like. In this way, the interior building material product according to the present invention can be used up without waste and therefore is excellent in effective utilization of resources and in economic efficiency. When sheet-like magnetic materials of about 10-cm square or about 15-cm square, not limited to those described above, are used, the interior building material according to the present invention is a useful product which can be easily cut into a width (length) of 10 cm, 15 cm, 20 cm, 40 cm, 45 cm, 50 cm, 60 cm, 70 cm, 75 cm, 80 cm, etc.

The shape of a plurality of sheet-like magnetic materials 2 that constitute the interior building material 10 according to the present invention is not limited to a square illustrated in FIG. 1 and FIG. 2, but may be any one of, for example, a rectangle (see FIGS. 3 and 4), a trapezoid (not illustrated in Figures), a circle (see FIG. 5), an ellipse (not illustrated in Figures), a triangle (see FIGS. 6 and 7), and the like. In the examples illustrated in Figures, the shapes of a plurality of sheet-like magnetic materials are the same, but in the present invention, the shapes are not limited to these, and combinations of the above-described geometrical figures may be used. For example, in interior finishing, it is preferable to appropriately select the shapes and disposition of the magnetic materials to use the magnetic materials so that a portion where the base material is greatly exposed exists in a region surrounded and formed by plurality of adjacent sheet like magnetic materials when considering that a case where through holes need to be provided in the interior building material occurs.

In addition, the interior building material 10 according to the present invention includes a plurality of sheet-like magnetic materials 2 disposed over the whole face of the base material 1 in the examples given in FIG. 1 to FIG. 10. It is preferable that the magnetic materials 2 be disposed in 90% or more, more preferably 95% of the area of the surface or back surface of the base material 1. However, the magnetic materials 2 are not necessarily disposed in this manner. For example, as illustrated in FIG. 11 and FIG. 12, the magnetic materials 2 may be disposed in a range where the convenience is considered to be improved when the surface of the interior building material can be attached to a magnet. Further, as illustrated in FIG. 8 to FIG. 10, it is also a preferred embodiment of the present invention that the constitution in which a plurality of sheet-like magnetic materials 2 are disposed in only the portion where there is a high possibility that the building material which is the base material 1 can be cut and used is adopted considering the construction efficiency, and a sheet-like magnetic material having a large area is disposed in a portion where there is no possibility that the building material is cut and used.

An important thing in the present invention is, rather than the range where a plurality of sheet-like magnetic materials are arranged, to adopt the constitution in which a state where a plurality of sheet-like magnetic materials are arranged is made, so that a blade of a cutter knife or the like can be easily inserted bet green the adjacent magnetic materials as necessary in construction work and the base material can be cut along the outer circumferences, of the sheet-like magnetic materials that is, sheet-like magnetic materials are not cut). That is, as a result of adopting such constitution, an interior building material can be made into a size as needed freely, and easily and without waste, and therefore it can be achieved to provide a product which can make the surface of a formed wall, in forming an interior wall, highly convenient in such a way that a magnet can attach thereto, and which is excellent in convenience/construction efficiency/economic efficiency by which the construction efficiency is not impaired, and the amount of left-over materials produced can be reduced.

More preferred embodiments of the Interior building material being the object of the present invention and having the constitution in which a blade of a cutter knife or the like can be easily inserted between adjacent magnetic materials include an embodiment using a building material in which a chamfered portion is provided at the outer edge (outer circumference) of at least one of a plurality of sheet-like magnetic materials 2, or, if necessary, of all the plurality of sheet-like magnetic materials 2. When such an embodiment is adopted, even in an interior building material having the constitution particularly as illustrated in FIG. 1 in which adjacent magnetic materials are disposed on the base material 1 in such a way as to be in contact with each other, and a plurality of sheet-like magnetic materials 2 are fixed in a state of being arranged without a gap, a blade of a cutter knife or the like can be inserted more easily between adjacent sheet like magnetic materials. In addition, when the chamfered portion is provided at the outer edge (outer circumference) of the magnetic materials 2, a blade of a cutter knife or the like can be easily inserted between the adjacent magnetic materials even in the state where a sheet-like material such as wallpaper is pasted to the surface of the interior building material according to the present invention, so that the interior building material according to the present invention is easily cut.

The method for fixing a plurality of sheet-like magnetic materials that constitute the interior building material according to the present invention on the base material may any of conventionally known methods. For example, the magnetic materials may be pasted to the base material with an adhesive or stopped to the base material with a double-sided tape. The adhesive is not particularly limited, and, for example, organic adhesives such as vinyl acetate-based adhesives and epoxy-based adhesives and inorganic adhesives such as alkali metal silicates may be used.

Examples of the sheet-like magnetic material that constitutes the interior building material according to the present invention include an iron sheet or a steel sheet. The steel sheet may be a surface-treated steel sheet on which a surface treatment has been performed. The surface treatment on the surface-treated steel sheet may be any of surface treatments that can make a state where a magnet attaches to the surface of the building material when the interior building material according to the present invention is constituted. Examples of the steel sheet include steel sheets plated with a mono metal (monometal-plated steel sheets) such as a zinc-plated steel sheet and steel sheets plated with alloy (alloy-plated steel sheets) such as hot-dip 55% aluminum-zinc alloy steel sheet (Galvalume®). In Examples, which will be described later, cases where galvanized steel sheets, as a representative example of the steel sheets are disposed are shown, but, as a matter of course, the steel sheet is not limited thereto.

The sheet-like magnetic material to be used in the present invention may be a sheet-like magnetic material having one through hole or a plurality of through holes (not illustrated in Figures). By constituting the sheet-like magnetic material in this way, a nail or a screw can be driven to this through hole during or after the construction work for the interior building material according to the present invention, and therefore the construction efficiency, convenience, and design property of the interior building material according to the present invention can be more improved. More specifically, for example, when the through hole is provided in the sheet-like magnetic material in the case of stopping the interior building material according to the present invention, in which the sheet-like magnetic materials are fixed to a base material face, the interior building material according to the present invention can be simply stopped with a screw or the like using a general-purpose electric tool by utilizing this through hole, and a surface state after stopping the interior building material according to the present invention is made flat and favorable. In contrast, in the case where a through hole is not provided in the sheet-like magnetic material, when an attempt of stopping the interior building material according to the present invention with a screw or the like using a general-purpose electric tool is made, a bulge occurs on the surface of the magnetic material (protrusion occurs on the side of the surface) to no small extent although it depends on the thickness of the magnetic material, and therefore there is a risk that when the surface of the magnetic material is finished with wallpaper or the like, a problem occurs to the appearance, and the design property is impaired. From these points, it is preferable that one through hole or a plurality of through holes be provided in advance in the sheet-like magnetic materials to be used in the present invention.

Accordingly, it is preferable that the size of the through hole be, for example, the size of about 10 to about 20 mm ϕ, in which the screw head or the nail head can fall. The position where the through hole is provided and the number of through holes are not particularly limited and may be appropriately determined considering improvements in the construction efficiency, improvements in the convenience, and improvements in the design property each obtained by providing a through hole or through holes in the interior building material according to the present invention. In addition, the through hole portions into which a screw head or a nail head falls can be treated to be flat by treating through hole portions using a plate material containing a magnetic material, and a resin or the like.

In addition, examples of preferred embodiments of the interior building material according to the present invention include an embodiment having constitution in which, on the surface side of a plurality of sheet-like magnetic materials such as iron sheets disposed on one face of the base material, a sheet of paper or the like is further pasted. By constituting the interior building material according to the present invention in this way, painting can be performed without performing a primer treatment, and, in addition, wall paper can be pasted with a usual paste for wallpaper. The material of the sheet to be used above is not limited to paper and may be any material. Examples of the preferred material include materials on which paste for wallpaper is easily spread or materials by which a surface property enabling a paint to be directly applied are obtained.

The thickness of the sheet-like magnetic material such as an iron sheet is not particularly limited as long as, for example, force of attraction by which one or more sheets of A4 printing paper can be held with one commercially available stopper with a magnet (so called magnet), which is a substitute for a thumbtack, is obtained. According to studies conducted by the present inventors, it is preferable that the thickness be specifically 0.1 mm or more, more preferably 0.2 mm or more. In addition, the thickness of the sheet-like magnetic material, such as an iron sheet, that constitutes the interior building material according to the present invention may be thick, but even when the thickness exceeds 1 mm, resultant force of attraction is not so large, and when thick magnetic materials are used, the interior building material is heavy although it depends on the range of disposing the sheet-like magnetic materials, so that it is concerned that the heavy interior building material is a cause for deteriorating the construction efficiency and the workability. In addition, when the thickness is too thick, material costs increase unnecessarily, which is uneconomical, and therefore it is preferable to make the thickness 1 mm or less. When the desired force of attraction is such an extent that a sheet of A4 paper is fixed with one magnet, use of a sheet-like magnetic material having a thickness of about 5 mm is enough. According to studies conducted by the present inventors, it is preferable that the sheet-like magnetic material have a thickness of about 0.8 mm in the case of considering that a heavy, small shelf is installed with a commercially available stopper with a magnet, the stopper having realized strong force of attraction.

Considering various situations that occur in the case where an inner wall face is formed, it is preferable that the interior building material according to the present invention be an interior building material that can exhibit the force of attraction at least to such an extent that a sheet of A4 paper can be held with one magnet as described previously. More specifically, it is desired that when the interior building material is stood in such a way as to be vertical, and one sheet of A4 plain paper is held at the portion where the sheet-like magnetic materials are disposed with one disk-like magnet having a diameter of a magnet portion of 17 mm ϕ and having a force of attraction of 3.5 N to an iron sheet having a thickness of 1 mm, the portion where the sheet-like magnetic materials that constitute the interior building material according to the present invention are disposed has force of attraction by which the plain paper does not fall. That the attraction force of the disk like magnet having a diameter of 17 mm ϕ used in the above-described test to the iron sheet having a thickness of 1 mm is 3.5 N is measured in the manner as illustrated in FIG. 13. That is, a magnet 5 with a hook, the magnet having a diameter of 17 mm ϕ, is placed on an iron sheet 3 having a thickness of 1 mm, and the magnet 5 is pulled over with the hook by hand under a condition of a testing speed of 3 mm/sec to read the maximum strength using Autograph (not illustrated in Figures).

Most common interior wall materials (base materials) include gypsum boards. In addition, among them, the gypsum boards which are most often used as an interior wall material are gypsum boards having a thickness of 9.5 to 10.0 mm or 12.5 to 13.0 mm. Accordingly, it is suitable that the thickness of the interior building material according to the present invention, in which a plurality of sheet-like magnetic materials, such as iron sheets, are arranged and fixed through a particular gap, is 9.5 to 10.0 mm or 12.5 to 13.0 mm because finishing work can be conducted without causing unevenness between a surrounding wall and the interior building material. Accordingly, it is preferable to use gypsum boards as the base material that constitutes the interior building material according to the present invention. The gypsum boards include, not limited to general-purpose boards, waterproof boards in which waterproof properties are improved, fire-resistant gypsum boards in which fire resistance performance is reinforced more, and the like. Besides, the base materials that constitute the interior building material include boards made of rock wool, boards using a glass fiber, and the like. According to studies conducted by the present inventors, in the interior building material according to the present invention of any embodiments in which a plurality of sheet-like magnetic materials are disposed on one face of a gypsum board in a state where adjacent magnetic materials are in contact with each other without a gap, or in which adjacent magnetic materials are disposed through a gap, the gypsum board which is a base material can be easily cut by easily inserting a blade of a cutter knife or the like between adjacent magnetic materials and making a cut into the base paper on the surface of the gypsum board under the magnetic materials. Therefore, by using an existing gypsum board as the base material, a product in which the convenience is highly enhanced can be realized without deteriorating high construction efficiency which the gypsum board has.

(Method for Constructing Interior Wall)

Examples of the method for constructing an interior wall according to the present invention include a method of attaching the interior building material according to the present invention to a wall, a ceiling, or the like, thereby forming the interior wall. On that occasion, by attaching the interior building material so that the magnetic materials fixed on the base material will face the indoor side, an interior wall such that the magnetic materials are disposed on the indoor side can be made. Here, a direction facing a wall, a ceiling, or the like to which the interior building material is to be attached is defined as the wall face side, and a direction opposite to the wall face side is defined as the indoor side.

As a specific method for constructing an interior wall, an interior wall can be formed by attaching the interior building material according to the present invention to a wall or a ceiling using, for example, at least one selected from an attachment member, an adhesive agent, and a pressure-sensitive adhesive agent. As the attachment member, for example, a nail and a screw can be used, as the adhesive agent, for example, a vinyl acetate resin-based emulsion-type adhesive agent, a vinyl acetate resin-based solvent-type adhesive agent, a synthetic rubber-based solvent-type adhesive agent, and a direct-pasting adhesive agent containing gypsum as the main component can be used, and as the pressure-sensitive adhesive agent, for example, a double-sided tape can be used. On that occasion, by using two or more of them together, such as, using the attachment member and the adhesive agent or the pressure-sensitive adhesive agent together, the attachment of the interior building material can be made firmer. Further, the interior building material may be attached by providing, at a wall, a ceiling or the like, a sandwiching material that make it possible to hold an edge part of the interior building material and inserting or fitting the edge part of the interior building material into the sandwiching material. On that occasion, the interior building material can be attached by using at least one selected from the attachment member, the adhesive agent, and the pressure sensitive adhesive agent together with the sandwiching material.

The interior building material to be used in the method for constructing an interior wall according to the present invention, when attached to a wall, a ceiling, or the like, is preferably attached to a surface of a substrate preliminarily prepared on the surface of the wall, the ceiling, or the like. The substrate is preferably a wooden substrate assembled with a wooden substrate material Jr a steel substrate assembled with a steel substrate material. The interior building material may be directly attached to a wall face of concrete or the like without assembling the substrate. In that case, it is preferable to paste the interior building material directly using an adhesive agent. Furthermore, the interior building material according to the present invention may be attached to the surface of the formed interior wall on the indoor side using at least one selected from the attachment member, the adhesive agent, and the pressure-sensitive adhesive agent.

The base material that constitute the interior building material to be used in the method for constructing an interior wall according to the present invention has dimensions of 400 mm to 1500 mm in width and 800 mm to 3000 mm in length, and 8 mm to 25 mm in thickness. Examples of the dimension of the width include 455 mm, 605 mm, 910 mm, 1000 mm, 1200 mm, and 1220 mm, examples of the dimension of the length include 1000 mm, 1500 mm, 1820 mm, 2000 mm, 2400 mm, 2420 mm, and 3000 mm, and examples of the dimension the thickness include 8 mm, 9 mm, 9.5 mm, 10.0 mm, 12.5 mm, 12.7 mm, 15.0 mm, 16.0 mm, 20.0 mm, 21.0 mm, and 25.0 mm. The interior building material to be used in the method for constructing an interior wall according to the present invention is one such that a plurality of sheet-like magnetic materials are fixed on a base material, and the dimension of the width of the base material and the dimension of the length of the base material are almost equal to the dimension of the width of the interior building material and the dimension of the length of the interior building material, respectively. In the interior building material and the base material, one surface of surfaces being composed of a width direction and length and having the largest area is defined as the main surface, and the other surface opposite to the main surface defined as the back surface. In the interior building material to be used in the method for constructing an interior wall according to the present invention, a plurality of the sheet-like magnetic materials are fixed to at least one surface of the main surface and the back surface of the base material.

The interior building material to be used in the method for constructing an interior wall according to the present invention can be attached to a wall face as it is or by cutting at a predetermined position, in accordance with the size of a wall face or ceiling to which the interior building material is to be attached, or the position of a window, a door, or the like.

A gypsum board which is used as a base material for the interior building material to be used in the method for constructing an interior wall according to the present invention is, as described above, a building material obtained by shaping a material which uses gypsum as a main component into a plate and wrapping the plate with a special paperboard (hereinafter, simply referred to as "paperboard"). That is, the gypsum board has a structure such that a plate-like gypsum core used as a core material and at least both surfaces thereof are covered with the paperboard. As the paperboard, paper is preferable, but a glass nonwoven fabric, a resin sheet, and the like can also be used.

In the method for constructing an interior wall according to the present invention, a saw, an electric saw, a cutter knife, and the like can be used for cutting a gypsum board which is used as a base material for the interior building material. In the case where a cutter knife is used for cutting a gypsum board, not only a cutter knife but also a sharp cutting tool having a blade whose thickness is thicker than a blade of a cutter knife can be used as well. Hereinafter, the cutter knife includes sharp cutting tools having a blade whose thickness is thicker than the blade of the cutter knife. In the case where a gypsum board is cut with a cutter knife, the gypsum board can be cut by making a cutline having a depth that enables cutting of the paperboard at a predetermined position on the main surface of the gypsum board, bending the gypsum board so that the main surface side where the outline has been made will become convex, and folding the gypsum board with the cutline as a starting point.

In addition, after making the outline on the main surface of the gypsum hoard, a outline may further be made on the back surface at a position opposite to the cutline made on the main surface. Thus, the gypsum board can be cut more easily.

The outline may have a depth that enables cutting of the paperboard, but the gypsum board cannot be folded unless the paperboard on the surface of the gypsum board has been cut completely, or there is a risk that the gypsum board cannot be folded at a predetermined position, and therefore when making a cutline on the surface of the gypsum board, it preferable to make a cutline having a depth that completely goes through the paperboard on the surface of the gypsum board. In addition, the cutline on the surface of the gypsum board may reach inside the gypsum core present under the paperboard.

Besides, in the method for constructing an interior wall according to the present invention, a ruler or the like may be used when a cutline is made at a predetermined position of the gypsum board.

In the interior building material to be used in the method for constructing an interior wall according to the present invention, the magnetic materials are disposed on the base material, and in the case where the base material is a gypsum board, a plurality of the sheet-like magnetic materials are fixed on the surface of the paperboard on at least one surface selected from the main surface or back surface of the gypsum board as the base material. In the case where the base material is a gypsum board the interior building material to be used in the method for constructing an interior wall according to the present invention is such that the gypsum board having the magnetic materials fixed on the base material can be cut using a cutter knife. Specifically, for example, the surface of the base material on which a plurality of the sheet-like magnet is materials of the interior building material are fixed is bent so as to be made convex to form a space between adjacent magnetic materials and a blade of a cutter knife is inserted to the formed space to make, on the paperboard provided on the surface of the gypsum board as the base material, a cutline having a depth that enables cutting of the paperboard. Then, the gypsum board is folded with the outline as a starting point by bending the gypsum board so that the side where a plurality of the magnetic materials of the interior building material have been fixed and the outline has been made is made convex, and thereby the interior building material can be cut between the adjacent magnetic materials. The outline is preferably provided on the surface of the gypsum board as the base material so as to have a depth that completely goes through the paperboard. In addition, when the interior building material is bent so as to be made convex to make a cutline, a high degree of bend leads to breakage of the interior building material, and therefore the interior building material is preferably bent to such an extent that a space where a blade of a cutter knife can be inserted is formed between adjacent magnetic materials. The interior building material in which the magnetic materials are disposed on the base material and which is used in the method for constructing an interior wall according to the present invention can be cut more easily by making a cutline in the manner as described above on the surface of the paperboard on the main surface where the magnetic materials are disposed and then further making a cutline on the back surface at a position opposite to the cutline on the surface of the paperboard.

In the case where a plurality of magnetic materials are also fixed on the surface of the back surface, in addition to the main surface of the interior building material, so as to have a portion where the magnetic materials are adjacent to each other and in contact with each other, a cutline can also be made on the paperboard on the surface on the back surface side of the gypsum board as the base material of the interior building material by bending the hack surface side where the magnetic materials are fixed so that the back surface side is made convex and inserting a blade of a cutter knife into a space formed between adjacent magnetic materials. Thus, the gypsum board can be cut by providing a cutline having a depth that enables cutting of the paperboard on the paperboards on the main surface side and the back surface side and folding the interior building material by bending the interior building material so that the main surface side or the back surface side will be made convex. In this case, the portion where the magnetic materials are adjacent to and in contact with each other on the main surface of the interior building material and the portion where the magnetic materials are adjacent to and in contact with each other on the hack surface of the interior building material are not necessarily located at positions corresponding to each other on the main surface and the back surface, but if these portions are not located at positions corresponding to each other on the main surface and the back surface, the positions of the cutlines formed on the paperboards on the surfaces of the main surface and the hack surface also do not correspond to each other, and there is a risk that when the interior building material is folded to cut the gypsum board, the shapes on the main side and the back side are different from each other, and therefore the portions where the magnetic materials are adjacent to and in contact with each other are preferably located at positions corresponding to each other on the main surface side and the back surface side. Also in the case where a plurality of magnetic materials are disposed on the back surface side of the interior building material, when making a cutline on the surface of the hack surface of the gypsum board as the base material, it is preferable to make a cutline having a depth that completely goes through the paperboard on the surface of the gypsum board, and when making a cutline by bending the interior building material so as to be made convex, it is preferable to bend the interior building material to such an extent that a space where a blade of a cutter knife can be inserted can be formed between adjacent magnetic materials.

In the case where the base material is a gypsum board, the interior building material to be used in the method for constructing an interior wall according to the present invention can be cut using a cutter knife as just described above, and the cut interior building material is such that one of the magnetic materials which were adjacent to and in contact with each other is fixed on the main surface of one of the cut pieces obtained by cutting, and the other magnetic material which was adjacent to and in contact with the one of the magnetic materials, before cutting the interior building material is fixed on the main surface of the other cut piece. That is, one or more magnetic materials are fixed on both of the cut pieces obtained by cutting. In the case where a plurality of magnetic materials are also fixed on the back surface of the interior building material so as to have a portion where the magnetic materials are adjacent to and in contact with each other, one of the magnetic materials which were adjacent to and in contact with each other before cutting the interior building material is fixed on each surface of the main surface and the back surface of one of the cut pieces obtained by cutting, and the other magnetic material which was adjacent to and in contact with the one of the magnetic materials before cutting the interior building material is fixed on each surface of the main surface and the back surface of the other cut piece.

In the method for constructing an interior wall according to the present invention, the interior building material is cut as just described above; at least one of the cut pieces obtained by cutting is attached to a wall or a ceiling using at least one selected from the attachment member, the adhesive agent, and the pressure-sensitive adhesive agent, or using two of the attachment member, the adhesive agent, and the pressure-sensitive adhesive agent together, as described above; and thereby the interior wall according to the present invention can be made. When the interior building material is attached, the interior building material is attached so that the magnetic materials are on the indoor side, and thereby an interior wall having magnetic materials having desired sizes and shapes at desired positions on the indoor side can be made. Further, a joint between the cut pieces and a groove formed by the edge part of the cut piece and wall face or the like are subjected to joint processing after the interior building material is attached, and thereby the surface of the interior wall can be made smooth.

Conventionally, to cut a magnetic material, a strong edged tool, such as a saw or an electric saw, is necessary, and when a magnetic material is to be cut by a cutter knife, there have been problems that the magnetic material cannot be cut, a large force is necessary even if the magnetic material can be cut, and a cutting position is shifted, and therefore it has been difficult to accurately cut the magnet material at a predetermined position. In the method for constructing an interior wall according to the present invention, a plurality of sheet-like magnetic materials are fixed on the base material of the interior building material so as to have a portion where the sheet-like magnetic materials are adjacent to and in contact with each other, and therefore in the case where the base material is a gypsum board, when the interior building material is cut using a cutter knife, a blade of a cutter knife can be inserted into a space formed between the magnetic materials, so that the interior building material can be cut without cutting the magnetic materials. Thus, in a construction site where the interior building materials will be attached to walls, ceilings, and the like, construction of the interior walls can be performed by the method excellent in construction efficiency in that the interior building materials can be cut easily and quickly only by using a cutter knife, which is a simple tool, without using a saw, an electric saw, or the like, and the interior building materials can be cut accurately. In addition, when the interior building materials are cut using a cutter knife, the blade of the cutter knife can be inserted into spaces formed between the magnetic materials, and therefore the interior building materials can be cut without damaging or breaking a plurality of the adjacent magnetic materials, so that loss of the interior building materials during construction can be reduced.

In the method for constructing an interior wall according to the present invention, a plurality of sheet-like magnetic materials are fixed on the base material of the interior building material so as to have a portion where the sheet-like magnetic materials are adjacent to and in contact with each other, and therefore in the case where the base material is a gypsum board, when the interior building material is cut using a cutter knife, the blade of the cutter knife is inserted into a space formed between the adjacent magnetic materials, making it possible to make a outline on the surface of the base material along the edge parts of the magnetic materials. By using the magnetic materials as the guide for the blade of the cutter knife in this way, a outline can be simply made on the surface of the base material to cut the interior building material without using a scale, which reduces construction time and makes construction efficiency in a site for constructing be interior walls more excellent.

In the method for constructing an Interior wall according to the present invention, it is preferable to preliminarily adjust the dimensions and sizes of the magnetic materials to be fixed on the base material of the interior building material in accordance with the place where the interior building material is to be attached. Usually in a construction site, when an interior wall is constructed, the dimensions of the place where the interior building material is to be attached are measured with a scale to cut the interior building material according to the dimensions, and when a plurality of magnetic materials having desired dimensions and sizes are preliminarily disposed and fixed on the base material as just described above, the interior building material to be used in the method for constructing an interior wall according to the present invention can be easily out by cutting the paperboard with a cutter knife along the edge parts of the magnetic materials already fixed on the surface, or by further making outlines on the gypsum core of the gypsum board as the base material, and therefore a series of operations such as measuring, with a scale, the dimensions of the place where the interior building material is to be attached and cutting the interior building material in accordance with the dimensions is unnecessary in a site of constructing interior walls and the load of a worker (contractor) at the site is reduced, which leads to reduction of construction time, and thus the method for constructing an interior wall is further excellent in construction efficiency.

Further, when the magnetic materials are fixed on the base material of the interior building material to be used in the method for constructing an interior wall according to the present invention, a plurality of sheet-like magnetic materials are fixed so as to have a portion where the sheet-like magnetic materials are adjacent to and in contact with each other. By adopting such constitution, the amount of left-over materials produced can be reduced and the number of times of cutting in a construction site can be reduced, and therefore such constitution can make the construction method excellent in convenience/construction efficiency/economic efficiency.

EXAMPLES

Hereinafter, the present invention will be described further specifically giving Examples. However, the present invention is not limited to these Examples.

Example 1

In an interior building material of the present Example, a plate-like member made of gypsum (gypsum board) and having a thickness of 12.5 mm, a length of 1820 mm, and a width of 901 mm was used as a base material. In addition, 18 sheets of 30-cm square galvanized steel sheets each having a thickness of 0.5 mm were prepared as sheet-like magnetic materials. Subsequently, as illustrated in FIG. 2, on the surface of the gypsum board, which is the base material 1, the 18 sheets of galvanized steel sheets 2 were disposed so that adjacent galvanized steel sheets were arranged orderly with 3 sheets in a horizontal direction×6 sheets in a vertical direction through a predetermined gap. Specifically, the galvanized steel sheets were disposed over the whole face of the base material by disposing the 3 sheets in the horizontal direction each through a gap formed by a linear narrow portion 3 having a width of 0.5 mm and disposing the 6 sheets in the vertical direction each through a gap formed by a linear narrow portion 3 having a width of 0.4 mm, and thus the interior building material of the present Example was obtained. A vinyl acetate-based adhesive was used as the means for fixing the galvanized steel sheets. It is to be noted that the gaps in FIG. 2 are illustrated to be larger than the actual size with emphasis in order to be easily understood.

The obtained plate-like interior building material 10 was observed visually and by means of touch to find that the appearance on the face of the side where the galvanized steel sheets were arranged to be disposed gave an impression which is similar to those of conventional gypsum boards because the gap between adjacent galvanized steel sheets were extremely narrow, and, in addition, the feeling of touching by hand was flat including the feeling of touching by hand on the face of the side where the galvanized steel sheets were disposed, which is similar to the feeling of touching by hand for conventional gypsum hoards.

In addition, the force of attraction by a magnet to the face of the side where the galvanized steel sheets were arranged to be disposed was checked by the following method. That is, the interior building material was stood in such a way as to be vertical, and sheets of A4 paper each having a thickness of 0.09 mm and a mass of 64 g/m$^2$ were held at the face of the galvanized steel sheet side with one magnet having a diameter of a magnet portion of 17 mm ϕ and having a force of attraction of 3.5 N to an iron sheet having a thickness of 1 mm. As a result, 5 sheets of paper can be held without a fall.

A blade of a cutter knife can be easily inserted into a gap portion formed by the linear narrow portion 3 having a width of 0.5 mm or having a width of 0.4 mm, the linear narrow portion 3 formed by adjacent galvanized steel sheets in the interior building material obtained above, and it was thereby ascertained that the interior building material can be easily cut. As a result, the interior building material cut without using a tape measure can be easily cut into members each having a width (length) of 30 cm or having a width (length) of 63 cm, etc.

Example 2

In an interior building material of the present Example, a plate-like member made of gypsum (gypsum board) and having a thickness of 12.5 mm, a length of 1800 mm, and a width of 900 mm was used as a base material 1. Subsequently, the plate-like interior building material of the present Example was obtained in the same manner as in Example 1 except that adjacent galvanized steel sheets were disposed in a state of being in contact with each other using 18 sheets of 30-cm square galvanized steel sheets, which are the same as those used in Example 1, and the sheet-like magnetic materials were fixed in a state of being arranged with 3 sheets in the horizontal direction×6 sheets in the vertical direction without a gap on the surface of the base material 1 as illustrated in FIG. 1. As a result, a building material in which the appearance gave an impression which is similar to those of conventional gypsum hoards, and, in addition, the feeling of touching by hand was flat including the feeling of touching by hand on the face of the side where the galvanized steel sheets were disposed, which is similar to the feeling of touching by hand for conventional gypsum boards was obtained, which was the same as in Example 1. With respect to the force of attraction by a magnet to the face of the side where the galvanized steel sheets were arranged to be disposed, 5 sheets of A4 paper can be held with the magnet, which was the same as in the case of Example 1.

A blade of a cutter knife can be easily inserted at a portion where adjacent galvanized steel sheets are in contact with each other by protruding the interior building material obtained above on the side where the galvanized steel sheets were arranged, and as a result, the plate-like member made of gypsum, which is a base material, can be easily cut. In addition, the interior building material cut without a tape measure can be easily cut into members each having a width (length) of 30 cm or having a width (length) of 60 cm, etc.

Example 3

In an interior building material of the present Example, a plate-like member made of gypsum and satisfying the size of a gypsum board defined in JIS Standard, the plate-like member having a thickness of 12.5 mm, a length of 1820 mm, and a width of 910 mm, was used as a base material 1. In addition, 18 sheets of 30.3-cm square galvanized steel sheets each having a thickness of 0.5 mm were prepared as sheet-like magnetic materials. Subsequently, as illustrated in FIG. 2, the 18 sheets of galvanized steel sheets were disposed so that adjacent steel sheets were arranged orderly with 3 sheets in a horizontal direction×6 sheets in a vertical direction through a predetermined gap. Specifically, the galvanized steel sheets were disposed over the whole face of the base material 1 by disposing the 3 sheets in the horizontal direction each through a gap formed by a linear narrow portion 3 having a width of 0.5 mm and disposing the 6 sheets in the vertical direction each through a gap formed by a linear narrow portion 3 having a width of 0.4 mm, and thus the interior building material of the present Example was obtained.

The plate-like interior building material obtained above was observed visually and by means of touch to find that the appearance on the face of the side where the galvanized steel sheets were arranged to be disposed gave an impression which is similar to those of conventional gypsum boards because the gap between adjacent galvanized steel sheets were extremely narrow, which was the same as in the building material of Example 1, and, in addition, the feeling of touching by hand was flat including the feeling of touching by hand on the face of the side where the galvanized steel sheets were disposed, which is similar to the feeling of touching by hand for conventional gypsum boards. The force of attraction to the face of the side where the galvanized steel sheets were arranged to be disposed was checked using the magnet having particular force of attraction to find that 5 sheets of A4 paper can be held with the magnet, which was the same as in the case of Example 1.

A blade of a cutter knife can be easily inserted into a gap portion formed by the linear narrow portion 3 having a width of 0.5 mm or having a width of 0.4 mm, the linear narrow portion 3 formed by adjacent galvanized steel sheets in the interior building material obtained above, and it was thereby ascertained that the interior building material can be easily cut. As a result, the interior building material cut without using a tape measure can be easily cut into members each having a width (length) of 30 cm or having a width (length) of 60 cm, etc.

REFERENCE SIGNS LIST

1: Base material
2: Sheet-like magnetic material
3; Narrow portion of gap
4: Iron sheet
5: Magnet: with hook, having force of attraction of 3.5 N
10: Interior building material

The invention claimed is:

1. A method for forming an interior wall with an interior building material, the method comprising:

bending the interior building material convexly so as to open a space capable for a blade of a cutter knife to be inserted, between a first magnetic material and a second magnetic material of a plurality of magnetic materials in the interior building material at a portion where the first magnetic material and the second magnetic material are adjacent to each other and abut each other on a base material of the interior building material;

inserting the blade of the cutter knife into the space between the first magnetic material and the second magnetic material so as to cut the interior building material between the first magnetic material and the second magnetic material of the plurality of magnetic materials in the interior building material, along a circumference of the first magnetic material and a circumference of the second magnetic material, without cutting any of the plurality of the magnetic materials, wherein the cut defines a first side of a portion and a second side of the portion of the interior building material between the first magnetic material and the second magnetic material, the first side of the portion of the interior building material having the first magnetic material and the second side of the portion of the interior building material having the second magnetic material; and forming the interior wall, with at least one piece selected from the group consisting of a piece comprising the first magnetic material at the first side and a piece comprising the second magnetic material at the second side, wherein the interior building material comprises a base material and the plurality of magnetic materials in a sheet shape, the base material is in a plate shape, the base material comprises a front surface and a back surface, and a magnet is not attracted to the base material, among the plurality of the magnetic materials, the first magnetic material and the second magnetic material are disposed on the front surface of the base material or on the back surface thereof and are adjacent to each other so as to abut each other, and the base material is a gypsum board.

2. The method for forming an interior wall with an interior building material according to claim 1, wherein the plurality of the magnetic materials in the sheet shape has a same shape among the plurality of the magnetic materials, and the same shape is at least one shape selected from the group consisting of a square, a rectangle, a trapezoid, a triangle, a circle, and an ellipse.

3. The method for forming an interior wall with an interior building material according to claim 2, wherein a length of four sides of the square if selected, two sides of the rectangle if selected, at least one side of the trapezoid if selected, at least one side of the triangle if selected, a diameter of the circle if selected, and at least one axis of the ellipse selected from the group consisting of a major axis and a minor axis if the ellipse is selected, is in a range from 10 cm to 35 cm.

4. The method for forming an interior wall with an interior building material according to claim 2, wherein each of the plurality of the magnetic materials has a same size.

5. The method for forming an interior wall with an interior building material according to claim 1, wherein at least one of the plurality of the magnetic materials has a through hole.

6. The method for forming an interior wall with an interior building material according to claim 1, wherein the interior building material holds while standing vertically, one sheet of A4 plain paper placed between one magnetic material among the plurality of the magnetic materials and one magnet placed over the A4 plain paper and the one magnetic material, wherein the one magnet is in a disk shape, has a diameter of a magnet portion of 17 mm, and has a force of attraction of 3.5 N to an iron sheet having a thickness of 1 mm.

7. The method for forming an interior wall with an interior building material according to claim 1, wherein in the interior building material, a paper sheet is pasted on the plurality of the magnetic materials.

8. The method for forming an interior wall with an interior building material according to claim 1, wherein the plurality of the magnetic materials has a thickness in a range from 0.1 to 1.0 mm.

9. The method for forming an interior wall with an interior building material according to claim 1, wherein the plurality of the magnetic materials has a thickness in a range from 0.2 to 0.8 mm.

10. The method for forming an interior wall with an interior building material according to claim 1, wherein at least one of the plurality of the magnetic materials is an iron sheet or a steel sheet, and at least one surface selected from the group consisting of a front surface of the magnetic materials and a back surface thereof is rust-proof.

11. The method for forming an interior wall with an interior building material according to claim 1, wherein the interior building material has a thickness in a range from 9.5 to 10.0 mm.

12. The method for forming an interior wall with an interior building material according to claim 1, wherein the interior building material has a thickness in a range from 12.5 to 13.0 mm.

13. The method for forming an interior wall with an interior building material according to claim 1, wherein among the plurality of the magnetic materials, the first magnetic material and the second magnetic material that are adjacent to each other and abut each other have a same shape and are a set of a plurality of sets, and the plurality of the sets is distributed to be aligned to be in a same pattern in at least one direction over the front surface or the back surface of the base material, entirely or partially, on which the plurality of the sets is disposed.

14. The method for forming an interior wall with an interior building material according to claim 1, wherein adjacent magnetic materials of the plurality of magnetic materials are aligned in at least one direction.

15. The method for forming an interior wall with an interior building material according to claim 1, wherein the plurality of the magnetic materials are disposed onto at least 90% of the front surface of the base material, or at least 90% of the back surface thereof.

* * * * *